US007492341B2

(12) United States Patent
Tachibana et al.

(10) Patent No.: US 7,492,341 B2
(45) Date of Patent: Feb. 17, 2009

(54) SEMICONDUCTOR CIRCUIT

(75) Inventors: Toshikazu Tachibana, Tachikawa (JP); Yoshitaka Iwasaki, Tachikawa (JP); Kazuya Endo, Higashimurayama (JP); Goro Sakamaki, Fuchu (JP)

(73) Assignee: Renesas Technology Corp., Tokyo (JP)

( * ) Notice: Subject to any disclaimer, the term of this patent is extended or adjusted under 35 U.S.C. 154(b) by 618 days.

(21) Appl. No.: 10/895,884

(22) Filed: Jul. 22, 2004

(65) Prior Publication Data

US 2005/0057549 A1 Mar. 17, 2005

(30) Foreign Application Priority Data

Aug. 27, 2003 (JP) ..... 2003-303480

(51) Int. Cl.
*G09G 5/00* (2006.01)

(52) U.S. Cl. ..... 345/98; 345/204

(58) Field of Classification Search ..... 345/204, 345/98

See application file for complete search history.

(56) References Cited

U.S. PATENT DOCUMENTS 5,701,273 A * 12/1997 Choi ..... 365/230.08
5,737,569 A * 4/1998 Nadir et al. ..... 711/149
5,844,515 A * 12/1998 Park ..... 341/144
5,995,073 A * 11/1999 Isami et al. ..... 345/89
6,518,946 B2 * 2/2003 Ode et al. ..... 345/98
6,518,964 B1 * 2/2003 Suits et al. ..... 345/419
6,535,189 B1 * 3/2003 Akiyama et al. ..... 345/87
6,559,839 B1 * 5/2003 Ueno et al. ..... 345/213
6,731,263 B2 * 5/2004 Goto et al. ..... 345/98
6,738,036 B2 * 5/2004 Janssen et al. ..... 345/87
6,924,782 B1 * 8/2005 Fujioka et al. ..... 345/92
6,927,753 B2 * 8/2005 Koyama et al. ..... 345/100

FOREIGN PATENT DOCUMENTS

JP 08-106272 4/1996

* cited by examiner

*Primary Examiner*—Bipin Shalwala
*Assistant Examiner*—Afroza Y Chowdhury
(74) *Attorney, Agent, or Firm*—Miles & Stockbridge P.C.

(57) ABSTRACT

A semiconductor circuit with the reduced scale of circuitry and a semiconductor integrated circuit chip which is obtained by integrating the semiconductor circuit and enables chip size reduction are provided. For this purpose, a two-decode method is used. The method uses: a pre-decode circuit comprising a first decoder of the preceding stage which decodes an arbitrary bit of an address signal of eight bits and a second decoder of the preceding stage which decodes the remaining bits; level conversion circuits which shift the output of the pre-decode circuit; and post-decode circuits which decode the decode outputs of the decoders in the pre-decode circuit, level-converted through the level conversion circuits.

14 Claims, 28 Drawing Sheets

SEMICONDUCTOR CIRCUIT

CROSS-REFERENCE TO RELATED APPLICATION

The present application claims priority from Japanese patent application No. JP 2003-303480 filed on Aug. 27, 2003, the content of which is hereby incorporated by reference into this application.

BACKGROUND OF THE INVENTION

The present invention relates to a semiconductor circuit. More particularly, it relates to a semiconductor circuit which constitutes a drive circuit for driving the pixels of an active panel-typed is play device using a liquid crystal panel, an organic electroluminescence panel, or the like.

An STN display device is so constituted that wiping is installed in two directions, x-axis direction (first direction) and y-axis direction (direction different from the first direction), throughout its display portion. When voltage is applied in the two directions, x and y, the liquid crystal at the intersection point is driven. An active matrix display device has an active element, such as thin film transistor (TFT), for each pixel, and in the display device, these active elements are switched and driven. These display devices are known as panel-type display device, such as liquid crystal display device and organic electroluminescence (organic EL) display device. The present invention is characterized in the circuitry of a semiconductor circuit which functions as a drive circuit for producing a screen display on a display panel, applied to these types of panel-type display devices. Also, the present invention is characterized in the circuit topology of a semiconductor integrated circuit chip wherein the above circuit is integrated.

For example, an active matrix liquid crystal display device using thin film transistors as active elements has a liquid crystal layer sealed between a pair of insulating substrates for which glass plates are favorably used. In its display area, a large number of pixels are formed in matrix arrangement. Outside the display area, a semiconductor integrated circuit chip as drive circuit is mounted. The thin film transistors constituting the individual pixels are led out of the display area through outgoing lines, and connected with this semiconductor integrated circuit chip. The thin film transistors disposed in the display area are connected with the, for example, 256 output terminals of gate drivers constituting the semiconductor integrated circuit chip through 256 gate lines in the scanning direction. The thin film transistors are selected by gate signals outputted through the output terminals, and the source lines of thin film transistors connected with the selected gate lines are supplied with indicative data. Thus, a screen display is produced.

In such an active matrix liquid crystal display device, liquid crystal driving voltage (gradation voltage) is applied to pixel electrodes for red (R), green (G), and blue (B) through thin film transistors. Therefore, no cross talk occurs between pixels, and a screen display with a large number of steps of gradation without cross talk can be produced.

FIG. 25 is a block diagram illustrating an example of the constitution of the gate driver unit the present inventors previously invented. FIG. 26 is an operating waveform chart of major parts of FIG. 25. In this constitution, address signals for selecting gate lines G1, G2, G3, G4, . . . , and G256 are of eight bits, and the address signals of eight bits [0] to [7] are counted up by address counters (not shown) and then inputted. The inputted address signals of eight bits [0] to [7] are decoded into (A000) to (A255) through a decode circuit DCR, and latched into latches LT on a latch clock. The decode outputs latched in the latches LT are inputted to a high breakdown voltage unit through NOR gates NR. The range of voltage level of the latched decode output is, for example, 3V to 0V. Shift registers may be used in place of the latch circuits.

The high breakdown voltage unit comprises level conversion circuits LS and a plurality (3×256 in this case) of high breakdown voltage inverters HV. Its output terminals (gate line terminals) GTM are connected with the gate lines of the display panel, and supply gate signals G1 to G256. The level conversion circuit LS converts inputted signals of 3V to 0V into as high a voltage level as 1.6V to −14V. Each of the gate line G1, G2, G3, G4, . . . , and G256 is provided with a gate driver GDR comprising a level conversion circuit LS and three high breakdown voltage inverters HV. The NOR gate NR is a gate for turning on and off a screen display on the display panel. During a non-display period when a full selection signal is inputted, the NOR gate NR discharges the electric charges in the pixels of the display portion.

The address signals of eight bits [0] to [7] are inputted as illustrated in FIG. 26, and latched into the latches LT when a latch clock is driven high. The latched address signals are level-shifted at the high breakdown voltage unit, and supplied as gate signals G1, G2, G3, . . . to corresponding gate lines through the gate line terminals GTM.

FIG. 27 is an explanatory drawing illustrating an example of the constitution of the level conversion circuit LS in FIG. 25, and FIG. 28 is an explanatory drawing illustrating a concrete example of the level conversion circuit LS in FIG. 25. The voltage values in FIG. 27 and FIG. 28 are as follows: VCC=3V; GND=0V; DDVDH=5V; VGH=15V; and VGL=−10V. This level conversion circuit LS comprises a series circuit of three high breakdown voltage inverters HV; a common inverter V connected in parallel with the series circuit; and a series circuit of three high breakdown voltage inverters HV. Its input is the output of a latch LT.

As illustrated in FIG. 27, the ranges of output voltage of various components are as follows: the range of output voltage of the inverter V is VCC to GND; the range of output voltage of the level conversion circuit LSa in the first stage constituting the level conversion circuit LS is DDVDH to GND; the range of output voltage of the level conversion circuit LSb in the second stage is DDVDH to VGL; and the range of output voltage of the level conversion circuit LSc in the final stage is VGH to VGL.

The level conversion circuit LSa in the first stage comprises four PMOS transistors and two NMOS transistors, as illustrated in the figure. The level conversion circuit LSb in the second stage comprises two PMOS transistors and four NMOS transistors, as illustrated in the figure. The level conversion circuit LSc in the final stage comprises two PMOS transistors and two NMOS transistors, as illustrated in the figure. The level conversion circuit LSb in the second stage and the level conversion circuit LSc in the final stage are connected together through two inverters.

FIG. 29 is an explanatory drawing illustrating an example of the constitution of the latch in FIG. 25. The latch comprises six inverters V and a NAND gate ND, as illustrated in the figure, and latches the output of the decode circuit DCR on a latch clock.

FIG. 30 is an explanatory drawing illustrating an example of the constitution of the 8-bit decode circuit in FIG. 25. The decode circuit comprises inverters V which are fed with eight bits [0] to [7] of an address signal, respectively, and NAND gates ND and NOR gates NR. Thus, the decode circuit produces 256 decode outputs (A000) to (A255).

FIG. 31 is a circuit diagram illustrating an example of the gateless driver the present inventors previously invented. This gateless driver GLDR is used together with a display panel GIPNL incorporating gates. The display panel GIPNL includes gate drivers which are formed over a substrate constituting a display panel. The gate drivers are constituted by thin film transistors formed of a high current mobility semiconductor film of low-temperature polysilicon or the like. The gate driver comprises a shift register SR, a high breakdown voltage NOR gate HNR, and a high breakdown voltage inverter HV with respect to each gate line.

The gateless driver GLDR comprises level conversion circuits LS which level-convert externally inputted full selection signals of, for example, 3V to 0V, frame leading pulses, and shift register clocks into large-amplitude signals of, for example, 16V to −14V. The gateless driver outputs these level-converted signals to the lead-out terminals GTM of the display panel GIPNL.

FIG. 32 is an explanatory drawing illustrating an example of the circuit of the shift register in FIG. 31, and FIG. 33 is a waveform chart illustrating the operation of the shift register in FIG. 32. The shift register comprises six high breakdown voltage inverters HV and two high breakdown voltage NOR gates HNR, as illustrated in the figure. The shift register is fed with a frame leading pulse which was level-shifted by a level shifter LS through the input terminal INPUT, and shifts it on a shift register clock which was similarly level-shifted by a level shifter LS. Its output is applied as gate signals G1, G2, G3, G4, . . . , and G256 to respective gate lines through the high breakdown voltage NOR gates HNR, the high breakdown voltage inverters HV, and its output terminal OUTPUT.

Documents disclosing this type of prior art include Patent Document 1.

[Patent Document 1] Japanese Unexamined Patent Publication No. Hei 8(1996)-106272

SUMMARY OF THE INVENTION

In the above-mentioned constitution of gate driver, the high breakdown voltage unit includes the gate drivers GDR each comprising a level conversion circuit LS and three high breakdown voltage inverters HV. Such a gate driver GDR is provided for each of the gate lines G1, G2, G3, G4, . . . , and G256. As described referring to FIG. 28 or FIG. 31, the level conversion circuit LS comprises a large number of MOS transistors, and its circuitry is complicated and of large scale. Further, the gate line width and the gate length are also large, and this increases the area of occupation. For this reason, in an attempt to integrate this circuit into a semiconductor chip, chip size reduction is limited. This is one of problems to be solved.

The object of the present invention is to provide the following by solving the above problem associated with prior art: a semiconductor circuit with the reduced scale of circuitry and a semiconductor integrated circuit chip which is obtained by integrating this semiconductor circuit and enables chip size reduction.

The present invention is characterized in that the above problem is solved by adopting a two-stage decode method. This method uses a pre-decode circuit and post-decode circuits. The pre-decode circuit comprises a first decoder of the preceding stage which decodes arbitrary bits of an address signal and a second decoder of the preceding stage which decodes the remaining bits. The post-decode circuits which decode the decode output of each decoder in the pre-decode circuit.

The semiconductor circuit according to the present invention is a gate driver for supplying gate signals to the gate terminals of a display panel wherein a large number of pixels comprising active elements having the gate terminals are arranged in a matrix pattern. The semiconductor circuit is characterized in that it adopts the following means.

"Means 1 for Implementing Semiconductor Circuit According to the Present Invention"

The semiconductor circuit comprises:

a pre-decode circuit comprising a first decoder of the preceding stage which decodes some bits of an address signal for selecting a gate terminal and a second decoder of the preceding stage which decodes the remaining bits of the address signal;

latch circuits which latch the decode outputs of the first decoder of the preceding stage and the second decoder of the preceding stage;

level conversion circuits which shift the respective voltage levels of decode outputs of the first decoder of the preceding stage and the second decoder of the preceding stage, latched into the latch circuits, to the high voltage side; and post-decode circuits which decode the outputs of the level conversion circuits.

"Means 2 for Implementing Semiconductor Circuit According to the Present Invention"

The semiconductor circuit comprises:

a latch circuit comprising a first latch which latches some bits of an address signal for selecting a gate terminal and a second latch which latches the remaining bits;

a pre-decode circuit comprising a first decoder of the preceding stage which decodes the some bits latched into the first latch and a second decoder of the preceding stage which decodes the remaining bits latched into the second latch;

level conversion circuits which shift the respective voltage levels of the outputs of the first decoder of the preceding stage and the second decoder of the preceding stage to the high voltage side; and post-decode circuits which decode the outputs of the first decoder of the preceding stage and the second decoder of the preceding stage, passed through the level conversion circuits.

"Means 3 for Implementing Semiconductor Circuit According to the Present Invention"

The semiconductor circuit comprises:

a latch circuit comprising a first latch which latches some bits of an address signal for selecting a gate terminal and a second latch which latches the remaining bits;

level conversion circuits which shift the respective voltage levels of the some bits and the remaining bits latched into the first latch and the second latch to the high level side;

a pre-decoder circuit comprising a first decoder of the preceding stage which decodes the outputs of the first latch, passed through the level conversion circuit, and a second decoder of the preceding stage which decodes the outputs of the second latch; and post-decode circuits which decode the decode outputs of the first decoder of the preceding stage and the second decoder of the preceding stage.

"Means 4 for Implementing Semiconductor Circuit According to the Present Invention"

The semiconductor circuit comprises:

a latch circuit comprising a first latch which latches some bits of an address signal for selecting a gate terminal and a second latch which latches the remaining bits;

level conversion circuits which shift the respective voltage levels of the some bits and the remaining bits, latched into the first latch and the second latch, to the high voltage side;

a pre-decode circuit comprising a first decoder of the preceding stage which decodes the output of the first latch passed through the level conversion circuits and a second decoder of the preceding stage which decodes the output of the second latch; and post-decode circuits which decode the decode outputs of the first decoder of the preceding stage and the second decoder of the preceding stage.

The post-decode circuit is constituted as a buffer-decoder which also functions as a buffer circuit placed between the pre-decode circuit and the gate terminals.

In the above-mentioned means 1 to 3, the waveform of output to the gate terminals varies between first reference voltage and second reference voltage whose level is lower than that of the first reference voltage. When it varies, the waveform has an inflection point between the first reference voltage and the second reference voltage.

The semiconductor integrated circuit chip according to the present invention supplies gate signals to the gate terminals of a display panel wherein a large number of pixels comprising active elements having the gate terminals and source terminals are arranged in a matrix pattern. Further, the semiconductor integrated circuit chip supplies indicative data to the source terminals. The semiconductor integrated circuit chip is characterized in that it adopts the following means: "Means 5 for Implementing Semiconductor Circuit According to the Present Invention"

The semiconductor integrated circuit chip comprises a system interface circuit which is fed with parallel signals from an external signal source; an external display interface circuit which is fed with RGB indicative data; a timing generating circuit; a gradation voltage generating circuit; a graphic RAM; a source driver; and a gate driver which supplies gate signals to the gate terminals.

The gate driver comprises a pre-decode circuit comprising a first decoder of the preceding stage which decodes some bits of an address signal for selecting a gate terminal, and a second decoder of the preceding stage which decodes the remaining bits of the address signal; and post-decode circuits which decode the decode outputs of the pre-decode circuit.

"Means 6 for Implementing Semiconductor Circuit According to the Present Invention"

The semiconductor integrated circuit chip comprises a system interface circuit which is fed with parallel signals from an external signal source; an external display interface circuit which is fed with RGB indicative data; a timing generating circuit; a gradation voltage generating circuit; a graphic RAM; a source driver; and a gate driver which supplies gate signals to the gate terminals.

The gate driver comprises:

a pre-decode circuit comprising a first decoder of the preceding stage which decodes some bits of an address signal for selecting gate terminals and a second decoder of the preceding stage which decodes the remaining bits of the address signal;

latch circuits which latch the decode outputs of the first decoder of the preceding stage and the second decoder of the preceding stage;

level conversion circuits which shift the respective voltage levels of the decode outputs of the first decoder of the preceding stage and the second decoder of the preceding stage, latched into the latch circuits, to the high voltage side; and post-decode circuits which decode the outputs of the level conversion circuits.

"Means 7 for Implementing Semiconductor Circuit According to the Present Invention"

The semiconductor integrated circuit chip comprises a system interface circuit which is fed with parallel signals from an external signal source; an external display interface circuit which is fed with RGB indicative data; a timing generating circuit; a gradation voltage generating circuit; a graphic RAM; a source driver; and a gate driver which supplies gate signals to the gate terminals.

The gate driver comprises:

a latch circuit comprising a first latch which latches some bits of an address signal for selecting a gate terminal, and a second latch which latches the remaining bits;

a pre-decode circuit comprising a first decoder of the preceding stage which decodes the some bits latched into the first latch and a second decoder of the preceding stage which decodes the remaining bits latched into the second latch;

level conversion circuits which shift the respective voltage levels of the outputs of the first decoder of the preceding stage and the second decoder of the preceding stage to the high voltage side; and post decode circuits which decode the outputs of the first decoder of the preceding stage and the second decoder of the preceding stage, passed through the level conversion circuits.

"Means 8 for Implementing Semiconductor Circuit According to the Present Invention"

The semiconductor integrated circuit chip comprises a system interface circuit which is fed with parallel signals from an external signal source; an external display interface circuit which is fed with RGB indicative data; a timing generating circuit; a gradation voltage generating circuit; a graphic RAM; a source driver; and a gate driver which supplies gate signals to the gate terminals.

The gate driver comprises:

a latch circuit comprising a first latch which latches some bits of an address signal for selecting a gate terminal, and a second latch which latches the remaining bits;

level conversion circuits which shift the respective voltage levels of the some bits and the remaining bits, latched into the first latch and the second latch, to the high voltage side;

a pre-decode circuit comprising a first decoder of the preceding stage which decodes the output of the first latch, passed through the level conversion circuit, and a second decoder of the preceding stage which decodes the output of the second latch; and post-decode circuits which decode the decode outputs of the first decoder of the preceding stage and the second decoder of the preceding stage.

"Means 9 for Implementing Semiconductor Circuit According to the Present Invention"

The semiconductor integrated circuit chip comprises a system interface circuit which is fed with parallel signals from an external signal source; an external display interface circuit which is fed with RGB indicative data; a timing generating circuit; a gradation voltage generating circuit; a graphic RAM; a source driver; and a gate driver which supplies gate signals to the gate terminals.

The gate driver comprises:

a latch circuit comprising a first latch which latches some bits of an address signal for selecting a gate terminal, and a second latch which latches the remaining bits;

level conversion circuits which shift the respective voltage levels of the some bits and the remaining bits, latched into the first latch and the second latch, to the high voltage side;

a pre-decode circuit comprising a first decoder of the preceding stage which decodes the output of the first latch, passed through the level conversion circuit, and a second decoder of the preceding stage which decodes the output of the second latch circuits; and post decode circuits which decode the decode outputs of the first decoder of the preceding stage and the second decoder of the preceding stage. The post-decode circuit is constituted as a buffer-decoder which also functions as a buffer circuit placed between the pre-decode circuit and the gate terminals.

The semiconductor circuit according to the present invention is so constituted that a plurality of bits of an address signal are not decoded in a lump, but are decoded once (pre-decode) and then decoded again (post decode). Thus, the number of level conversion circuits is significantly reduced.

The present invention is not limited to the inventions according to the claims descried later, and, needless to add, it may be modified in various ways to the extent that the technical philosophy underlying it is not departed from.

BRIEF DESCRIPTION OF THE DRAWINGS

FIG. 17(*a*) illustrates an example of the layout of an integrated circuit chip mounted with the semiconductor circuit the present inventors previously invented. FIG. 17(*b*) illustrates an example of the layout of an integrated circuit chip mounted with the semiconductor circuit according to the present invention.

FIG. 18(*a*) illustrates another example of the layout of an integrated circuit chip mounted with the semiconductor circuit the present inventors previously invented. FIG. 18(*b*) illustrates another example of the layout of an integrated circuit chip mounted with the semiconductor circuit according to the present invention.

FIG. 21(*a*) illustrates an example of the layout of the semiconductor integrated circuit chip the present inventors previously invented. FIG. 21(*b*) illustrates an example of the layout of the semiconductor integrated circuit chip according to the present invention.

DETAILED DESCRIPTION OF THE PREFERRED EMBODIMENTS

Figure 1:
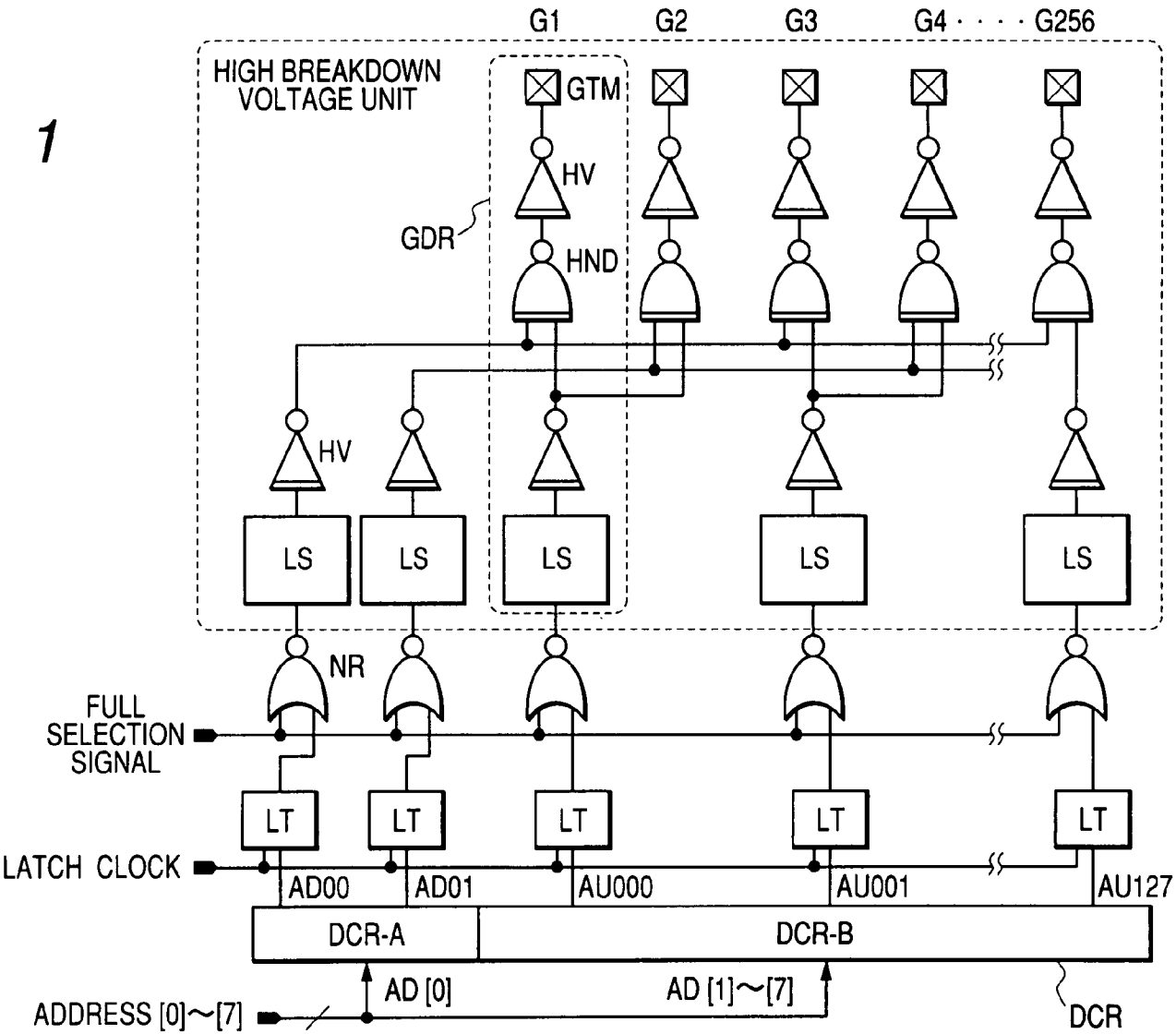
FIG. 1 is a block diagram illustrating an example of the constitution of a gate driver unit for driving a display panel, which is a first embodiment of the semiconductor circuit according to the present invention.

Referring to the drawings, the embodiments of the present invention will be described in detail below.

First Embodiment

FIG. 1 is a block diagram illustrating an example of the constitution of the gate driver unit for driving a display panel, which is the first embodiment of the semiconductor circuit according to the present invention. There is no special limitation on its constitution and it may be formed over a single semiconductor substrate made of silicon single crystal or the like. In FIG. 1, the gate lines G1, G2, G3, G4, . . . , and G256 correspond to the gate lines of the display panel. The address signal for selecting these gate lines is of eight bits. This address signal of eight bits [0] to [7] is counted up by address counters (not shown) and then inputted to the decoder DCR.

Part (one bit) of the eight bits [0] to [7] of the inputted address signal is decoded at the first decoder DCR-A of the preceding stage in the decoder DCR. Its decode outputs AD00 and AD01 are latched into latches LT, respectively. This latch is carried out with the timing of a latch clock. The remaining seven bits of the address signal are decoded at the second decoder DCR-B of the preceding stage in the decoder DCR to obtain decode outputs AU000, AU001, . . . , and AU127. These decode outputs are latched into the respective latches LT.

The decode output latched into each latch LT is inputted to the high breakdown voltage unit through a NOR gate NR. The range of voltage level of the latched decode outputs is, for example, 3V to 0V. A shift register may be used instead of the latch circuit.

In the high breakdown voltage unit, the decode outputs AD00 and AD01 for "one bit" decoded at the first decoder DCR-A of the preceding stage are converted into as high a voltage level as 16V to −14V through the level conversion circuits LS, respectively. Then, the decode outputs AD00 and AD01 are outputted through the high breakdown voltage inverters HV. The decode outputs AU000, AU001, . . . , and AU127 for "seven bits" respectively latched into the latches LT are converted into as high a voltage level as 16V to −14V through the level conversion circuits LS, respectively. Thereafter, the decode outputs AU000, AU001, . . . , and AU127 are inputted to the gate drivers GDR each comprising a high breakdown voltage NAND gate HND and a high breakdown voltage inverter HV.

Figure 25:
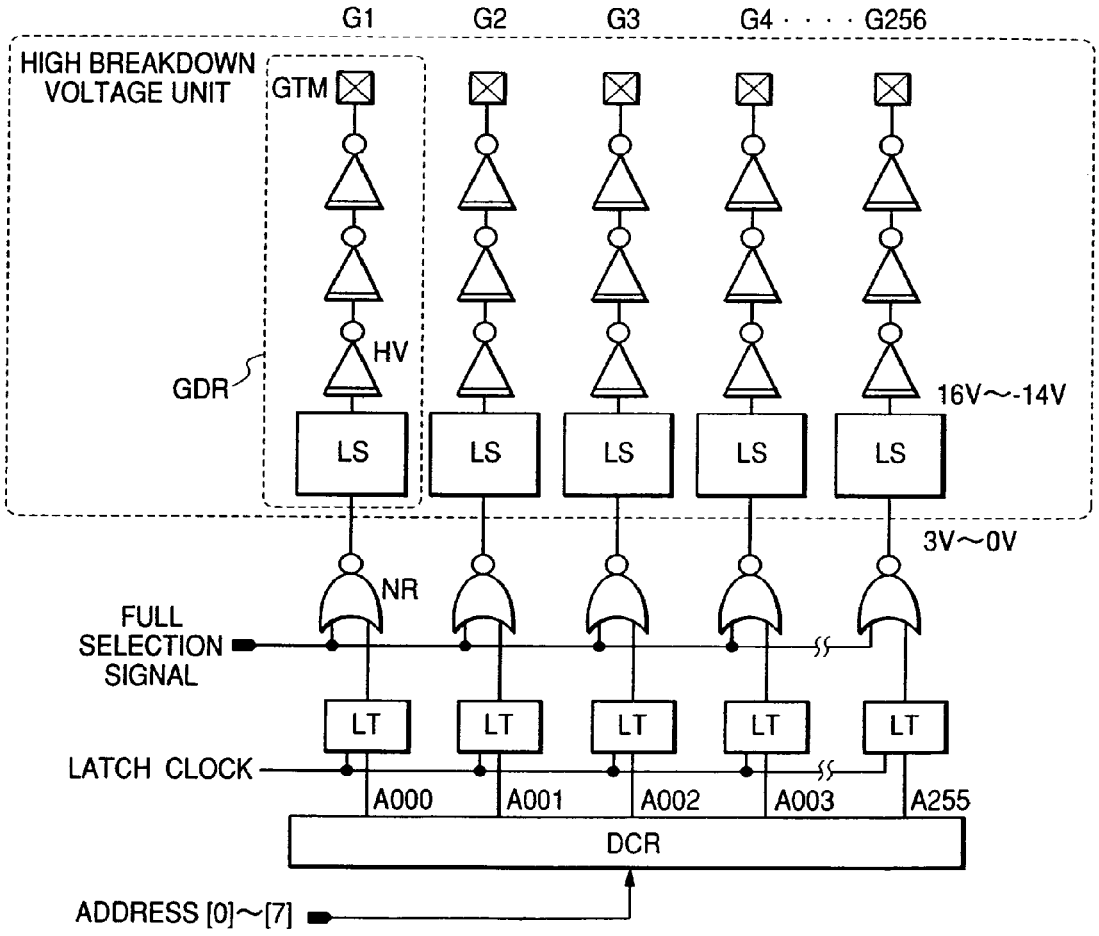
PRIOR ART FIG. 25
FIG. 25 is a block diagram illustrating an example of the constitution of a gate driver unit.
Figure 26:
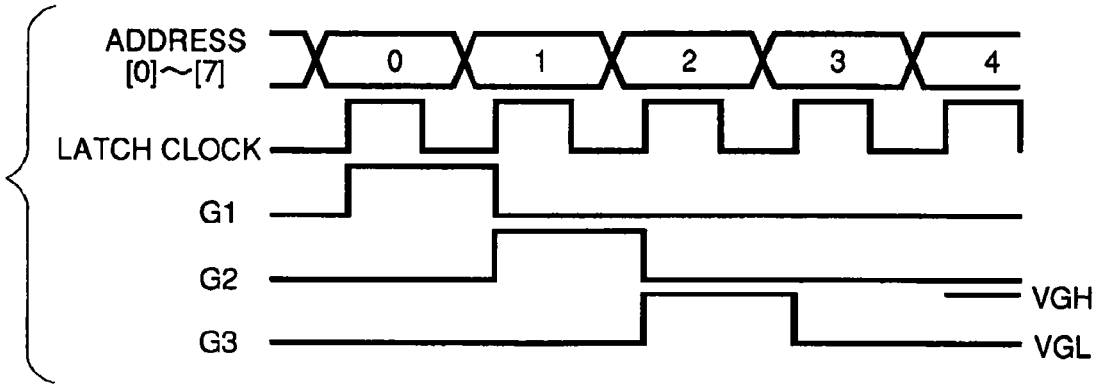
FIG. 26 PRIOR ART
FIG. 26 is an operating waveform chart of the major parts of the gate driver unit illustrated in FIG. 25.
Figure 27:
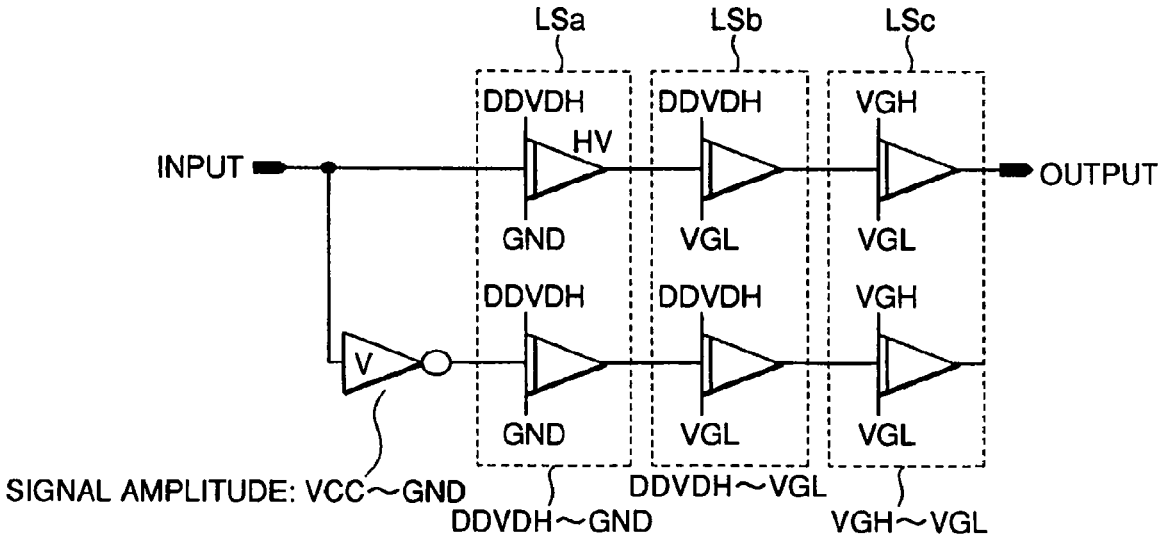
FIG. 27 PRIOR ART
FIG. 27 is an explanatory drawing illustrating an example of the constitution of the level conversion circuit LS in FIG. 25.
Figure 28:
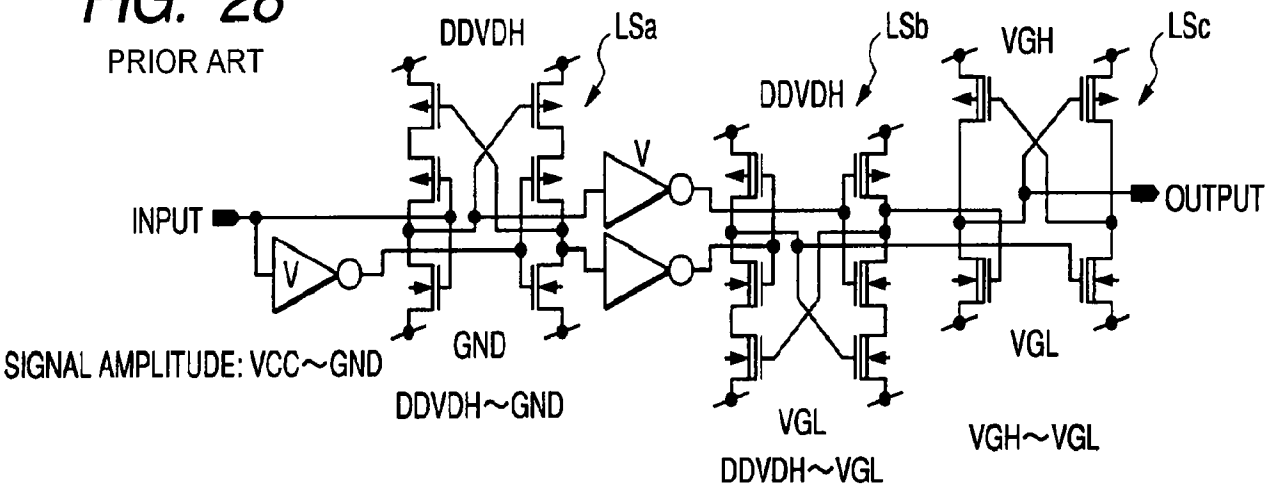
FIG. 28 PRIOR ART
FIG. 28 is an explanatory drawing illustrating a concrete example of the level conversion circuit LS in FIG. 25.
Figure 29:
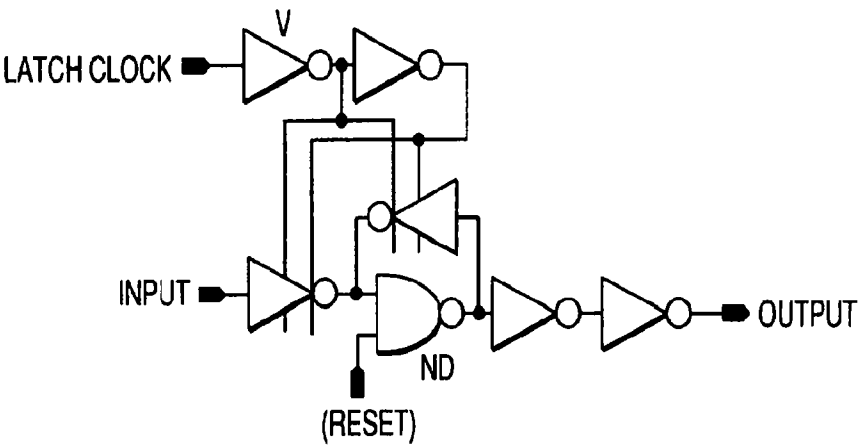
FIG. 29 PRIOR ART
FIG. 29 is an explanatory drawing illustrating an example of the constitution of the latch in FIG. 25.
Figure 30:
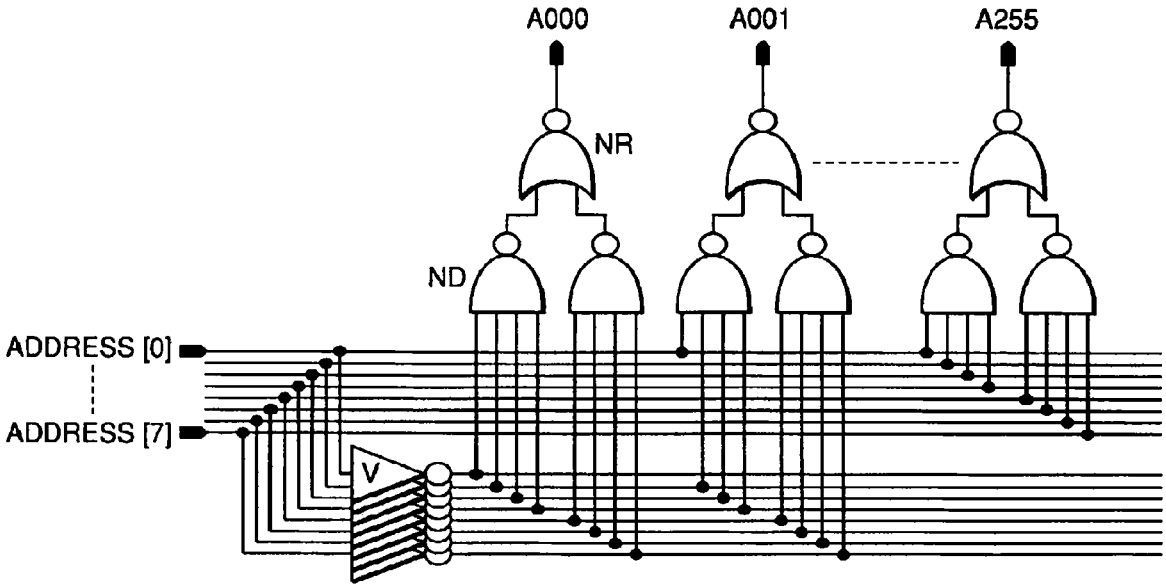
FIG. 30 PRIOR ART
FIG. 30 is an explanatory drawing illustrating an example of the constitution of the 8-bit decode circuit in FIG. 25.
Figure 31:
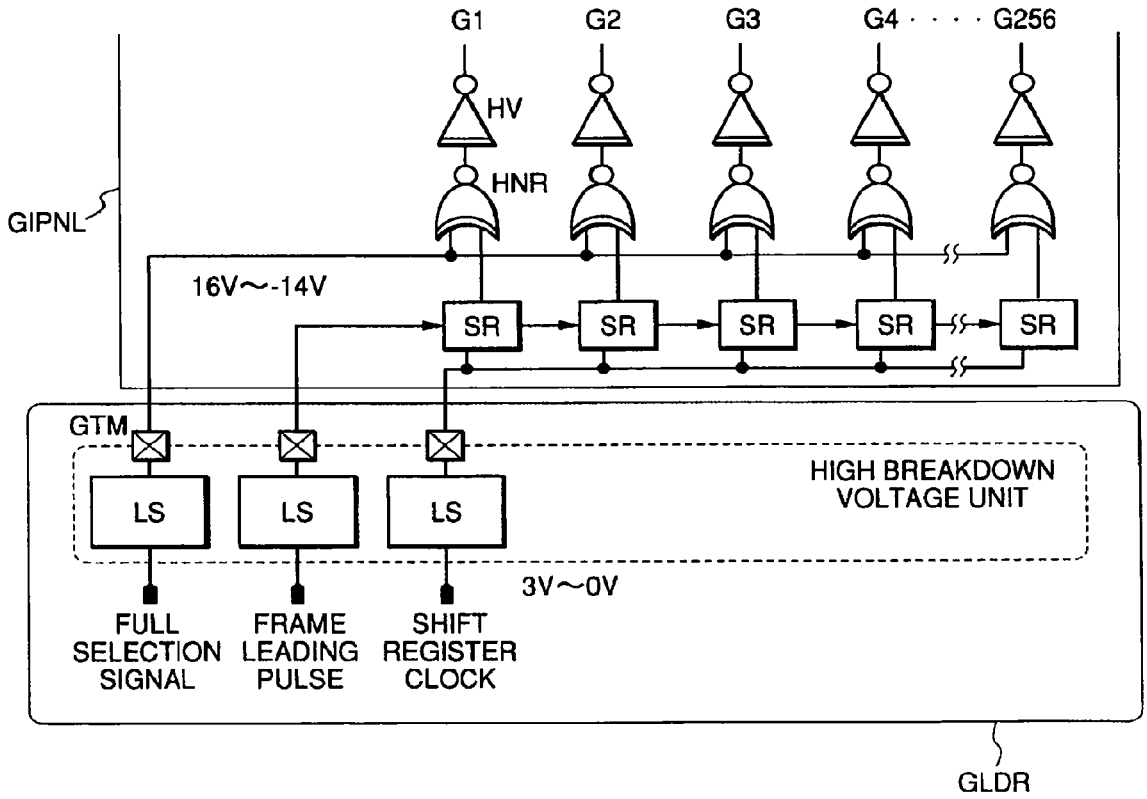
FIG. 31 PRIOR ART
FIG. 31 is a circuit diagram illustrating an example of a gateless driver.
Figure 32:
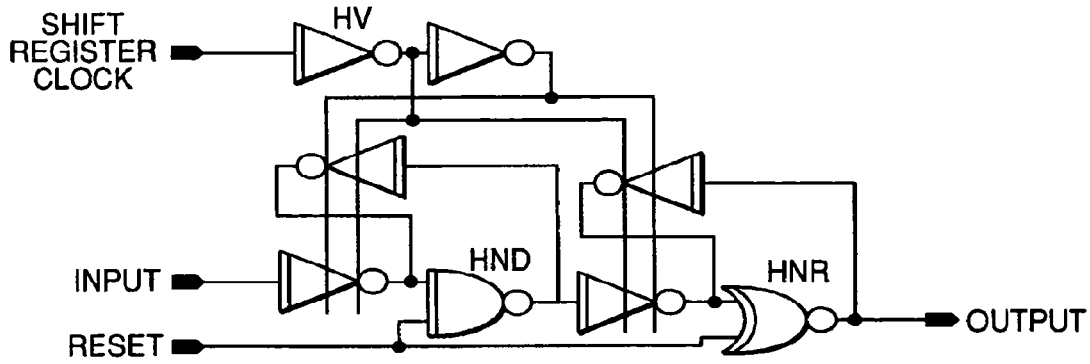
FIG. 32 PRIOR ART
FIG. 32 is an explanatory drawing illustrating an example of the circuit of the shift register in FIG. 31.
Figure 33:
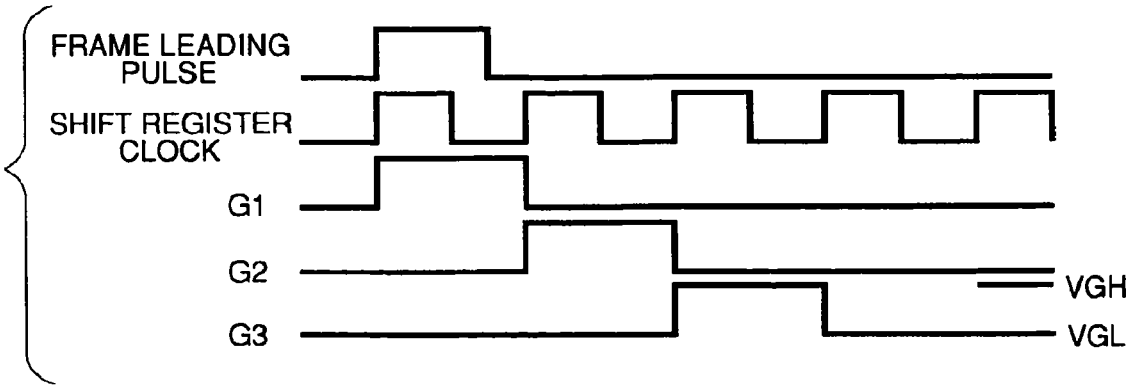
FIG. 33 PRIOR ART
FIG. 33 is a waveform chart illustrating the operation of the shift register in FIG. 32.

The gate driver GDR is provided for each of the gate lines G1, G2, G3, G4, . . . , and G256. Either input of each of these high breakdown voltage NAND gates HND is fed with the level conversion output of the decode outputs AD00 and AD01 for "one bit." As in FIG. 25, the NOR gate NR is a gate for turning on and off a screen display on the display panel. During a non-display period when a full selection signal is inputted, the NOR gate NR discharges the electric charges in the pixels of the display portion.

Figure 2:
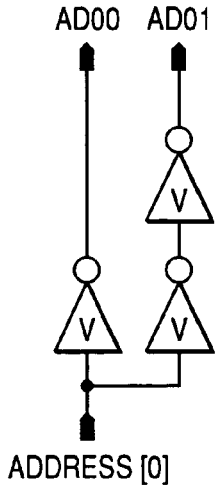
FIG. 2 is a schematic diagram of a decoder DCR-A for "one bit" constituting the decoder DCR in FIG. 1.

FIG. 2 is a schematic diagram illustrating the decoder DCR-A for "one bit" constituting the decoder DCR in FIG. 1. This decoder DCR-A comprises three inverters V, and outputs decode outputs AD00 and AD01 with respect to bit "0", which is one bit of an address signal.

Figure 3:
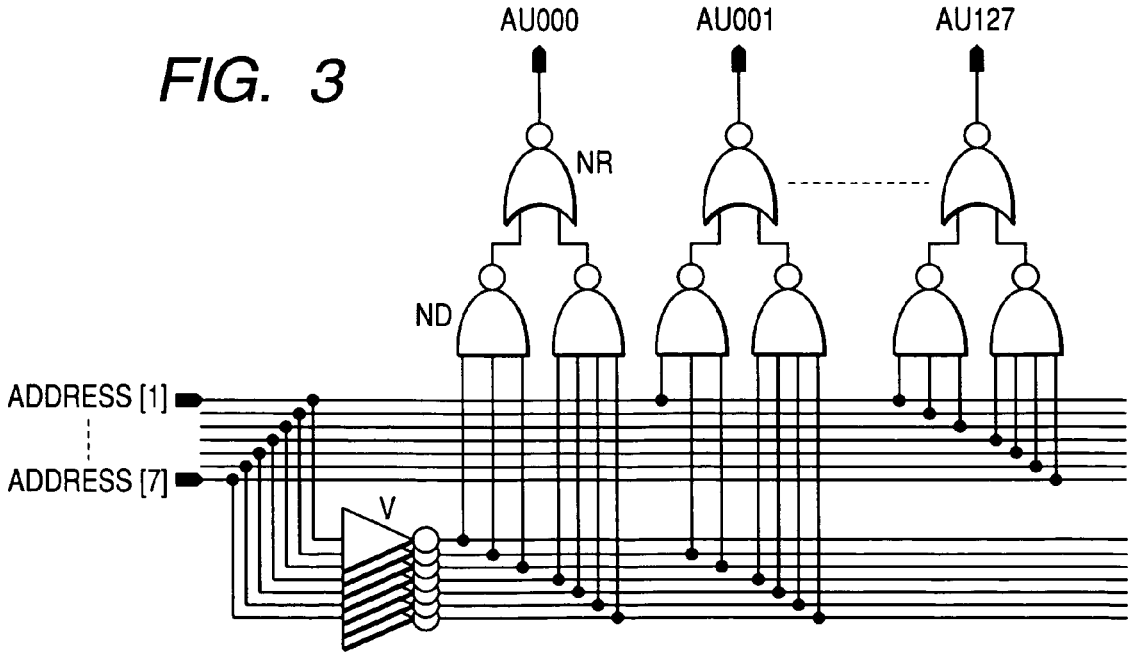
FIG. 3 is a schematic diagram of a decoder DCR-B for "seven bits" constituting the decoder DCR in FIG. 1.

FIG. 3 a schematic diagram illustrating the decoder DCR-B for "seven bits" constituting the decoder DCR in FIG. 1. This decoder DCR-B comprises eight inverters V, six NAND gates ND, and three NOR gates NR. With respect to bits "1" to "7," which are seven bits of the address signal, the decoder DCR-B outputs decode outputs AU000, AU001, . . . , and AU127.

Figure 4:
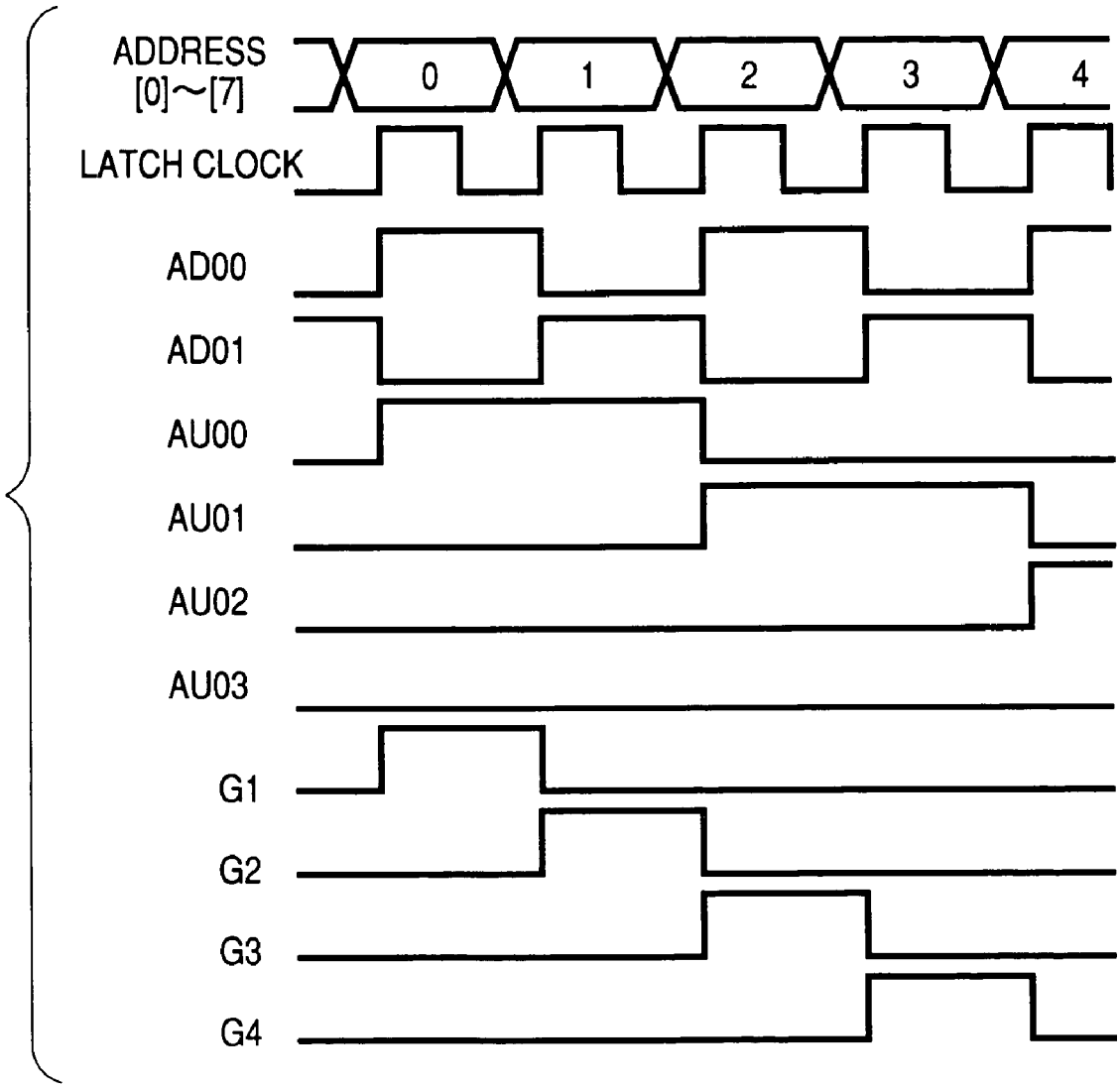
FIG. 4 is a waveform chart illustrating the operation of the gate driver in FIG. 1.

FIG. 4 is a waveform chart illustrating the operation of the gate driver in FIG. 1, and the symbol for each waveform corresponds to the portion marked with the same symbol in FIG. 1. An inputted address signal of eight bits [1] to [7] is taken into the latches on a latch clock. This is done by latching the bits into the latches LT when the latch clock is driven high. Bit "0", which is the latched "one bit" of the address signal, is pre-decoded into AD00 and AD01. Bits "1" to "7", which are the "seven bits" of the address signal, are pre-decoded into AU000, AU001, . . . , and AU127.

The pre-decode outputs AD00 and AD01 for bit "0" corresponding to "one bit" and the pre-decode outputs AU000, AU001, . . . , and AU127 for bits "1" to "7" corresponding to "seven bits" are level-shifted at the high breakdown voltage unit. Thereafter, the pre-decode outputs AU000, AU001, . . . , and AU127 for bits "1" to "7" are decoded again at the gate drivers GDR (post-decode). At this time, they are decoded together with the pre-decode outputs AD00 and AD00 for bit "0" corresponding to "one bit." The post-decoded address data is respectively supplied as gate signals G1, G2, G3, . . . to the corresponding gate lines through the gate line terminals GTM.

As mentioned above, this embodiment is so constituted that: a plurality of bits of an address signal are not decoded in a lump. Instead, they are divided into two groups at an arbitrary bit, and the groups of bits are individually decoded (pre-decode). The outputs resulting from them are latched into latch circuits, and the latched outputs are level-converted and then decoded again (post-decode). Thus, the number of level conversion circuits is significantly reduced.

In this embodiment, two-stage decode is carried out. This method is such that the eights bits of an address signal are not decoded in a lump; instead, the bits are divided into one bit and seven bits, and pre-decoded; thereafter, the bits are level-converted and then post-decoded (full decode). Thus, the number of level conversion circuits can be reduced substantially in half from 256 to 130 (128+2). Two level conversion circuits are for one bit of an address signal, and 128 level conversion circuits are for seven bits of the address signal. However, high breakdown voltage NAND circuits HND for post-decode are added to the high breakdown voltage unit. Nevertheless, the number of level conversion circuits can be significantly reduced as compared with the constitution illustrated in FIG. 25.

The one bit at which the bits of an address signal are divided may be arbitrary, but the highmost bit or lowmost bit is preferably selected with the facilitation of circuit constitution taken into account. To minimize the wire routing, lowest bit is suitable.

Second Embodiment

Figure 5:
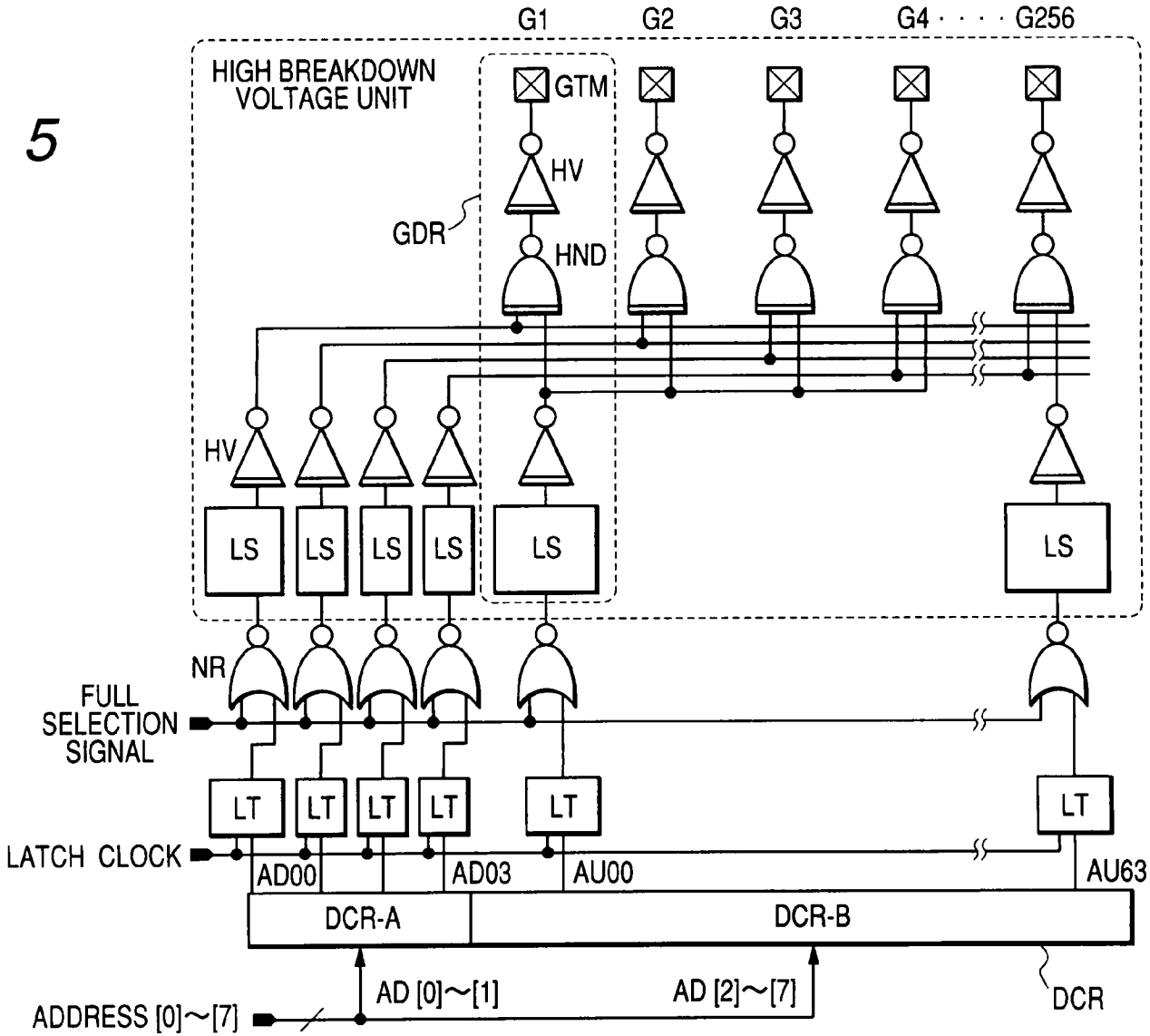
FIG. 5 is a block diagram illustrating an example of the constitution of a gate driver unit for driving a display panel, which is a second embodiment of the semiconductor circuit according to the present invention.

FIG. 5 is a block diagram illustrating an example of the constitution of the gate driver unit for driving a display panel, which is the second embodiment of the semiconductor circuit according to the present invention. In this embodiment, the eight bits of an address signal are divided into two bits and six bits, and decoded. In this figure, the same symbols as in FIG. 1 denote the same functional components as in FIG. 1. In this embodiment, the eight bits [0] to [7] of an address signal are divided into two bits AD[0] and [1] and six bits AD[2] to [7]. The decoder DCR for pre-decode comprises the first decoder DCR-A of the preceding stage and the second decoder DCR-B of the preceding stage.

The two bits AD[0] and [1] of the address signal are decoded into decode outputs AD00 to AD03 by the first decoder DCR-A of the preceding stage, and the decode outputs AD00 to AD03 are latched into the latches LT, respectively. The latch is carried out with the timing of a latch clock. The remaining "seven bits" AD[2] to [7] of the address signal are decoded into decode outputs AU00 to AU63 by the second decoder DCR-B of the preceding stage, and the decode outputs AU00 to AU63 are latched into the latches LT, respectively. As in the first embodiment, thereafter, the outputs are fully decoded at the post-decoders, and supplied as gate signals G1, G2, G3, . . . to the corresponding gate lines through the gate line terminals GTM.

Figure 6:
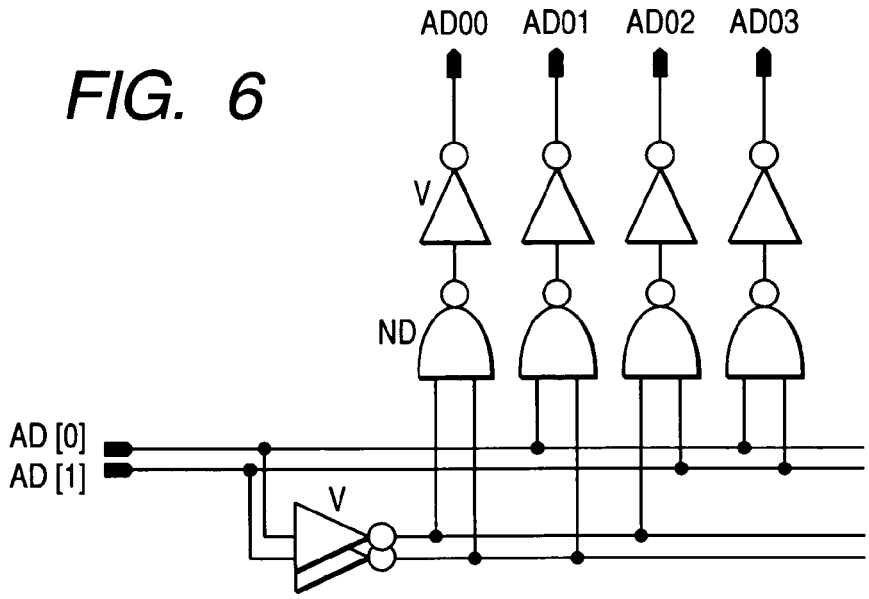
FIG. 6 is an explanatory drawing of the circuitry of a 2-bit decoder in FIG. 5.
Figure 7:
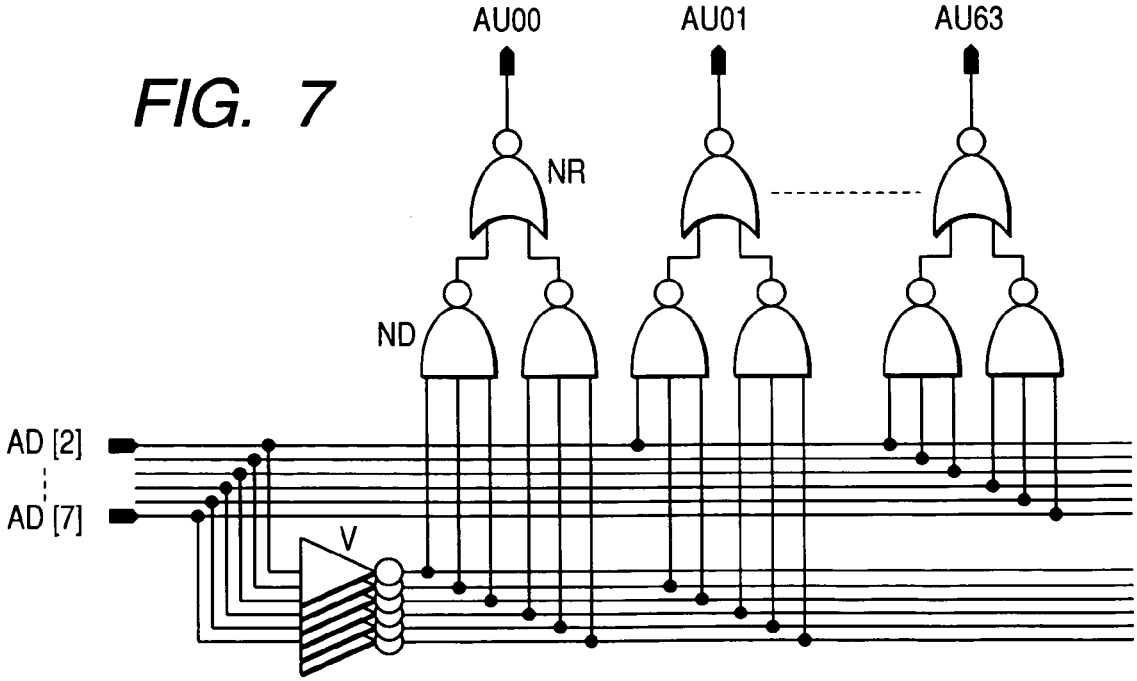
FIG. 7 is an explanatory drawing of the circuitry of a 6-bit decoder in FIG. 5.

FIG. 6 is an explanatory drawing illustrating the circuitry of the 2-bit decoder in FIG. 5, and FIG. 7 is an explanatory drawing illustrating the circuitry of the 6-bit decoder in FIG. 5. The 2-bit decoder comprises two inverters V, four NAND gates ND, and four inverters V connected with the output terminals of the NAND gates ND. The 6-bit decoder comprises six inverters V, 128 NAND gates ND, and 64 NOR gates NR connected with the output terminals of the NAND gates ND.

In this embodiment, the number of level conversion circuits LS can be reduced substantially to ¼ from 256 in FIG. 25 to 68 (64+4). The four level conversion circuits LS are for two bits of an address signal, and the 64 level conversion circuits are for six bits of the address signal. However, high breakdown voltage NAND circuits HND for post-decode are added to the high breakdown voltage unit. Nevertheless, the number of level conversion circuits can be significantly reduced as compared with the constitution illustrated in FIG. 25. With this constitution, the number of the level conversion circuits is 68. If the bits of an address signal are divided into four bits and four bits, however, the number of the level conversion circuits is minimized to 32.

Third Embodiment

Figure 8:
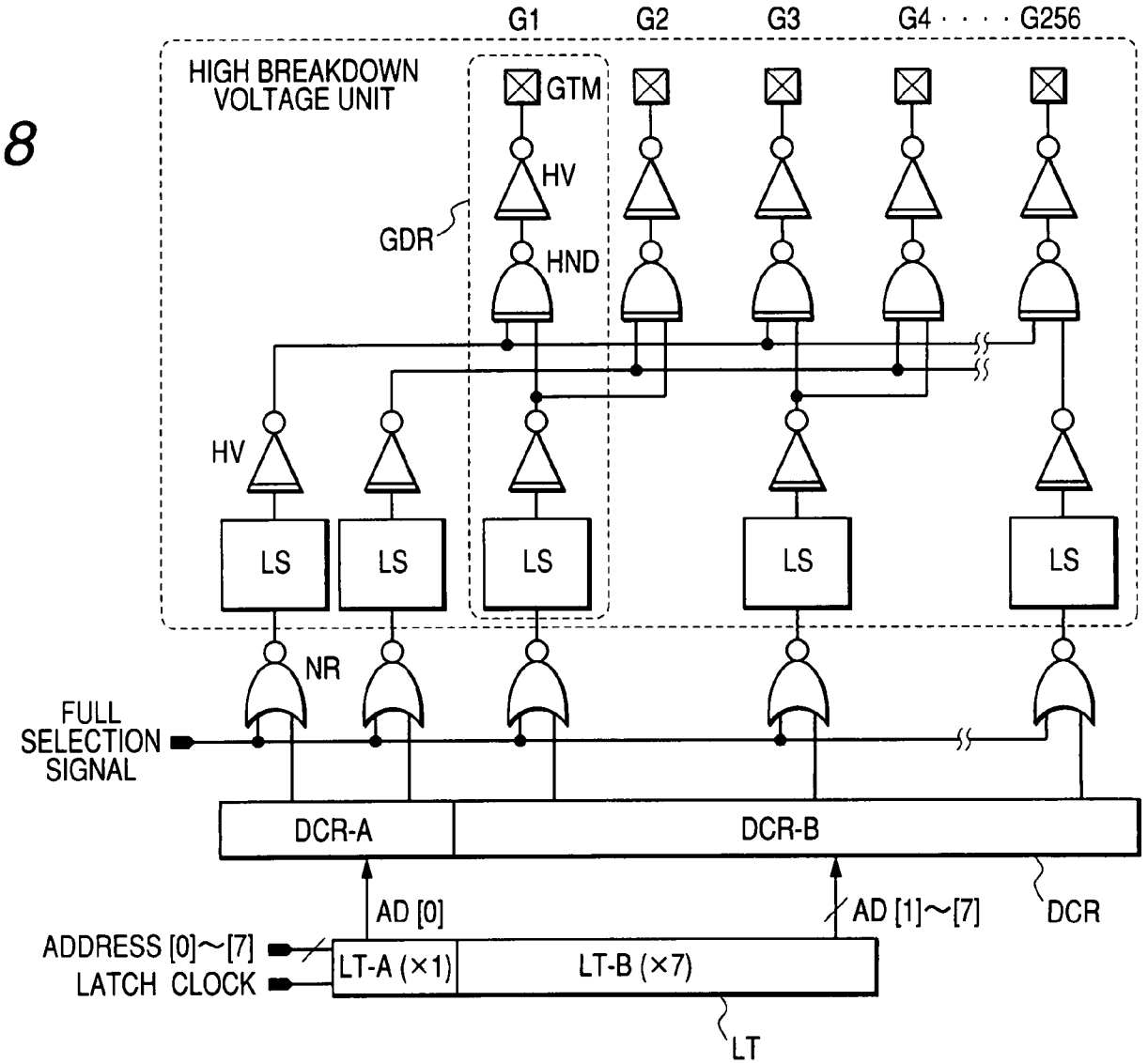
FIG. 8 is a block diagram illustrating an example of the constitution of a gate driver unit for driving a display panel, which is a third embodiment of the semiconductor circuit according to the present invention.

FIG. 8 is a block diagram illustrating an example of the constitution of the gate driver unit for driving a display panel, which is the third embodiment of the semiconductor circuit according to the present invention. In this embodiment, a latch circuit for latching address signals of eight bits is placed in the stage preceding the pre-decoder. The 8-bit address signal is latched as follows: the latch circuit LT comprises a first latch circuit LT-A and a second latch circuit LT-B. The first latch circuit LT-A latches one bit AD[0] of the inputted 8-bit address signal, and the second latch circuit LT-B latches seven bits AD[1] to [7] of the inputted 8-bit address signal.

AD[0] latched into the first latch circuit LT-A is decoded by the first decoder DCR-A in the pre-decoder DCR, and AD[1] to [7] latched into the second latch circuit LT-B are decoded by the second decoder DCR-B. With respect to the other aspects, the constitution is the same as in FIG. 1. As in the first embodiment, thereafter, the outputs are fully decoded at the post-decoders, and supplied as gate signals G1, G2, G3, . . . to the corresponding gate lines through the gate line terminals GTM.

As mentioned above, this embodiment is so constituted that: a plurality of bits of an address signal are not decoded in a lump. Instead, they are divided into two groups at an arbitrary bit, and latched into a latch circuit. The latched groups of bits are respectively decoded (pre-decode). The outputs resulting from pre-decode are level-converted, and then decoded again (post-decode). Thus, the number of level conversion circuits is significantly reduced. The number of level conversion circuits can be reduced substantially in half from 256 in FIG. 25 to 130 (128+2). The two level conversion circuits are for one bit of an address signal, and the 128 level conversion circuits are for seven bits of the address signal. Thus, the number of level conversion circuits can be significantly reduced as compared with the constitution illustrated in FIG. 25.

The one bit at which the bits of an address signal are divided maybe arbitrary, but the highmost bit or lowmost bit is preferably selected with the facilitation of circuit constitution taken into account. To minimize the wire routing, lowest bit is suitable.

Fourth Embodiment

Figure 9:
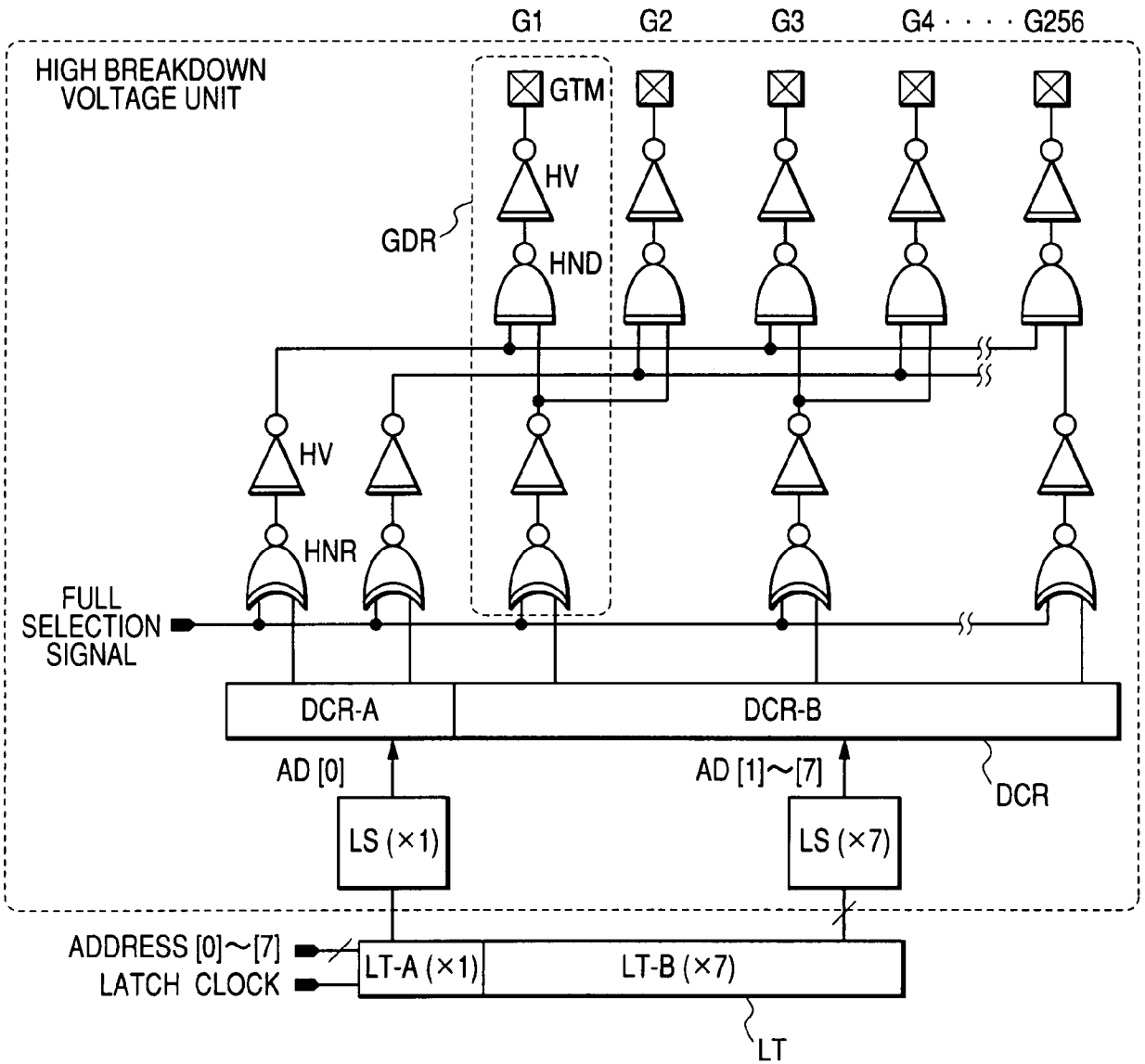
FIG. 9 is a block diagram illustrating an example of the constitution of a gate driver unit for driving a display panel, which is a fourth embodiment of the semiconductor circuit according to the present invention.

FIG. 9 is a block diagram illustrating an example of the constitution of the gate driver unit for driving a display panel, which is the fourth embodiment of the semiconductor circuit according to the present invention. In this embodiment, a latch circuit for latching address signals of eight bits is placed in the stage preceding the pre-decoder. At the same time, the output of the latch circuit is provided with level conversion circuits. With respect to the other aspects, the constitution is the same as in FIG. 8.

One bit AD[0] of an inputted address signal of eight bits [0] to [7] is latched into the first latch LT-A in the latch circuit LT, and the remaining seven bits AD[1] to [7] are latched into the second latch LT-B. AD[0] of the address signal latched into the first latch LT-A is decoded by the first decoder DCR-A in the pre-decoder DCR, and AD[1] to [7] of the address signal latched into the second latch LT-B are decoded by the second decoder DCR-B. The subsequent signal processing is the same as in FIG. 1 and FIG. 8.

As mentioned above, this embodiment is so constituted that: a plurality of bits of an address signal are not decoded in a lump. Instead, they are divided into two groups at an arbitrary bit, and the groups of bits are latched into a latch circuit, respectively. The latched groups of bits are level-converted, and the output of the latch circuit is decoded (pre-decode) and then decoded again (post-decode). Thus, the number of level conversion circuits is significantly reduced. Since the level conversion circuits LS are placed in the stage preceding the decoder DCR, the number of them can be reduced to a number corresponding to the number of bits of the address signal. Therefore, the number of level conversion circuits can be further reduced than in the first, second, and third embodiments.

Fifth Embodiment

Figure 10:
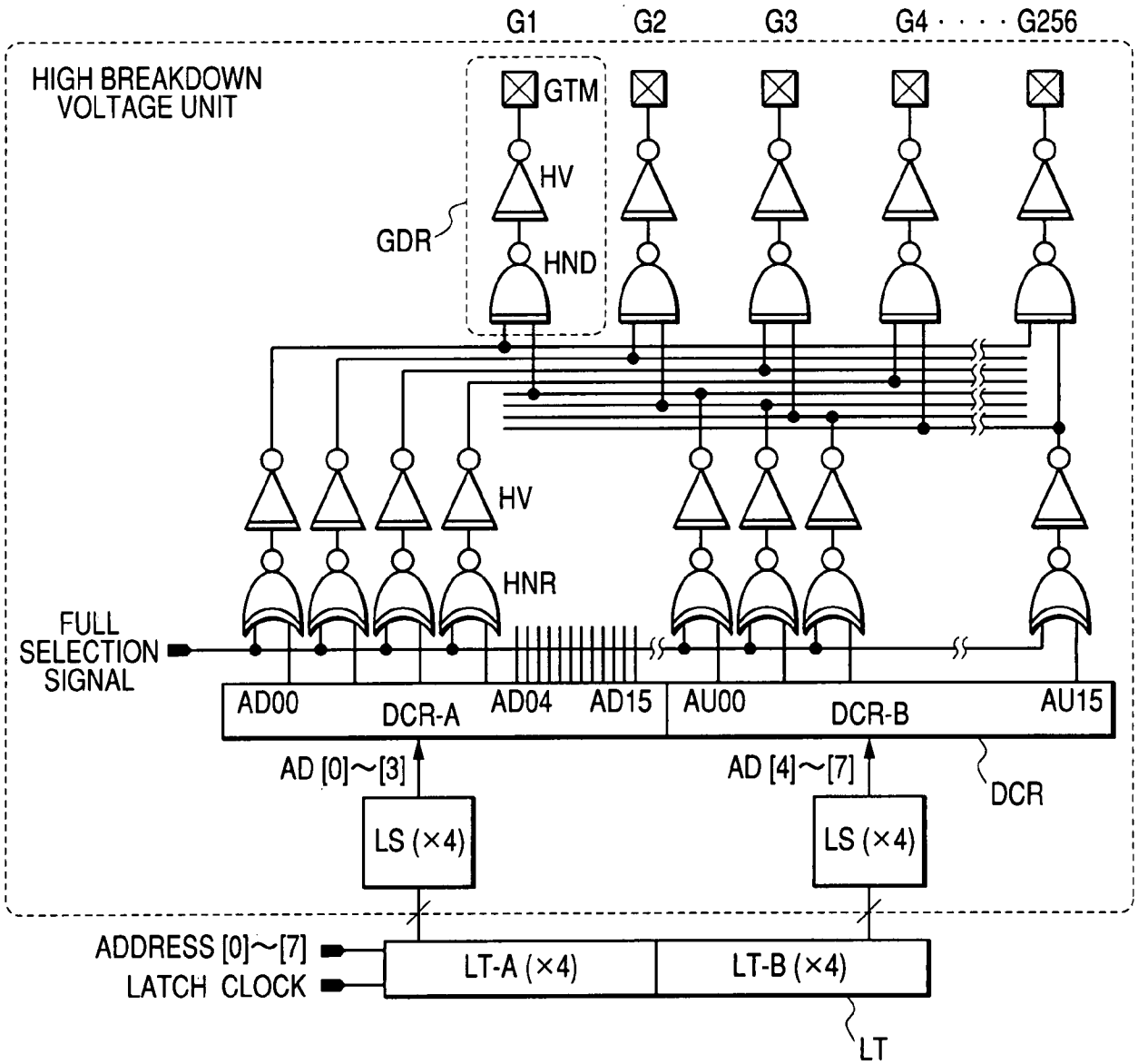
FIG. 10 is a block diagram illustrating an example of the constitution of a gate driver unit for driving a display panel, which is a fifth embodiment of the semiconductor circuit according to the present invention.

FIG. 10 is a block diagram illustrating an example of the constitution of the gate driver unit for driving a display panel, which is the fifth embodiment of the semiconductor circuit according to the present invention. In this embodiment, a latch circuit LT for latching inputted address signals is placed in the stage preceding the pre-decoder DCR. At the same time, the output of the latch circuit LT is provided with level conversion circuits LS. An address signal of eight bits is divided into four bits AD[0] to [3] and four bits AD[4] to [7]. With respect to the other aspects, the constitution and operation are the same as in FIG. 9.

In this embodiment, four bits AD[0] to [3] of an address signal are latched into a first latch circuit LT-A, and the remaining four bits AD[4] to [7] of the address signal are latched into a second latch circuit LT-B. The output of the first latch circuit LT-A is provided with four level conversion circuits LS, and the output of the second latch circuit LT-B is provided with four level conversion circuits LS. A pre-decode circuit DCR is connected with the outputs of the two sets of the four level conversion circuits LS. The pre-decode circuit DCR comprises a first decoder DCR-A and a second decoder DCR-B, each of which corresponds to the four respective level conversion circuits LS. The outputs of the four respective level conversion circuits LS are inputted to the first decoder DCR-A and the second decoder DCR-B corresponding to the four respective level conversion circuits LS, and pre-decode there. With respect to the other aspect, including post-decoder, the constitution is the same as in FIG. 9.

Figure 11:
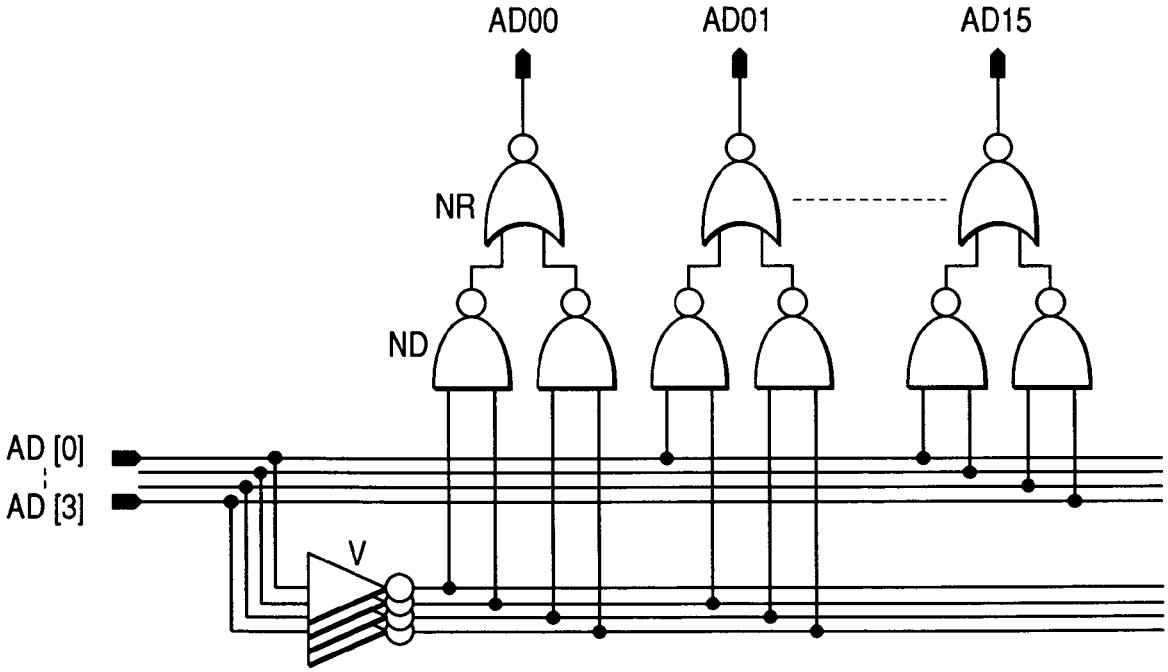
FIG. 11 is a circuit diagram illustrating an example of the constitution of the decoder circuit in FIG. 10.

FIG. 11 is a circuit diagram illustrating an example of the constitution of the decoder circuit in FIG. 10. This 4-bit decoder circuit comprises four inverters V, 32 NAND gates ND, and 16 NOR gates NR. The decoder circuit is fed with AD[0] to [3] of an address, and outputs decoded address signals AD00 to AD15.

As mentioned above, this embodiment is so constituted that: a plurality of bits of an address signal are not decoded in a lump. Instead, they are divided into two groups at an arbitrary bit, and the groups of bits are latched into a latch circuit, respectively. The latched groups of bits are level-converted. The output of the latch circuit is decoded (pre-decode), and then decoded again (post-decode). Thus, the number of level conversion circuits is significantly reduced. Since the level conversion circuits LS are placed in the stage preceding the decoder DCR, the number of them can be reduced to a number corresponding to the number of bits of the address signal. Therefore, the number of level conversion circuits can be further reduced than in the first, second, and third embodiments. The number of elements of the pre-decoder circuit can be significantly reduced as compared with the constitution in FIG. 9. With respect to the first to fifth embodiments, examples in which the level conversion circuits LS are placed in the stage preceding or subsequent to the pre-decoder circuit have been taken. The position of installation of level conversion circuits which minimizes the packaging area is determined by the ratio of the area of level conversion circuits to the area of decoder circuit DCR. Sometimes, the area can be restricted by the number of signal lines for pre-decode signal and the like.

Sixth Embodiment

Figure 12:
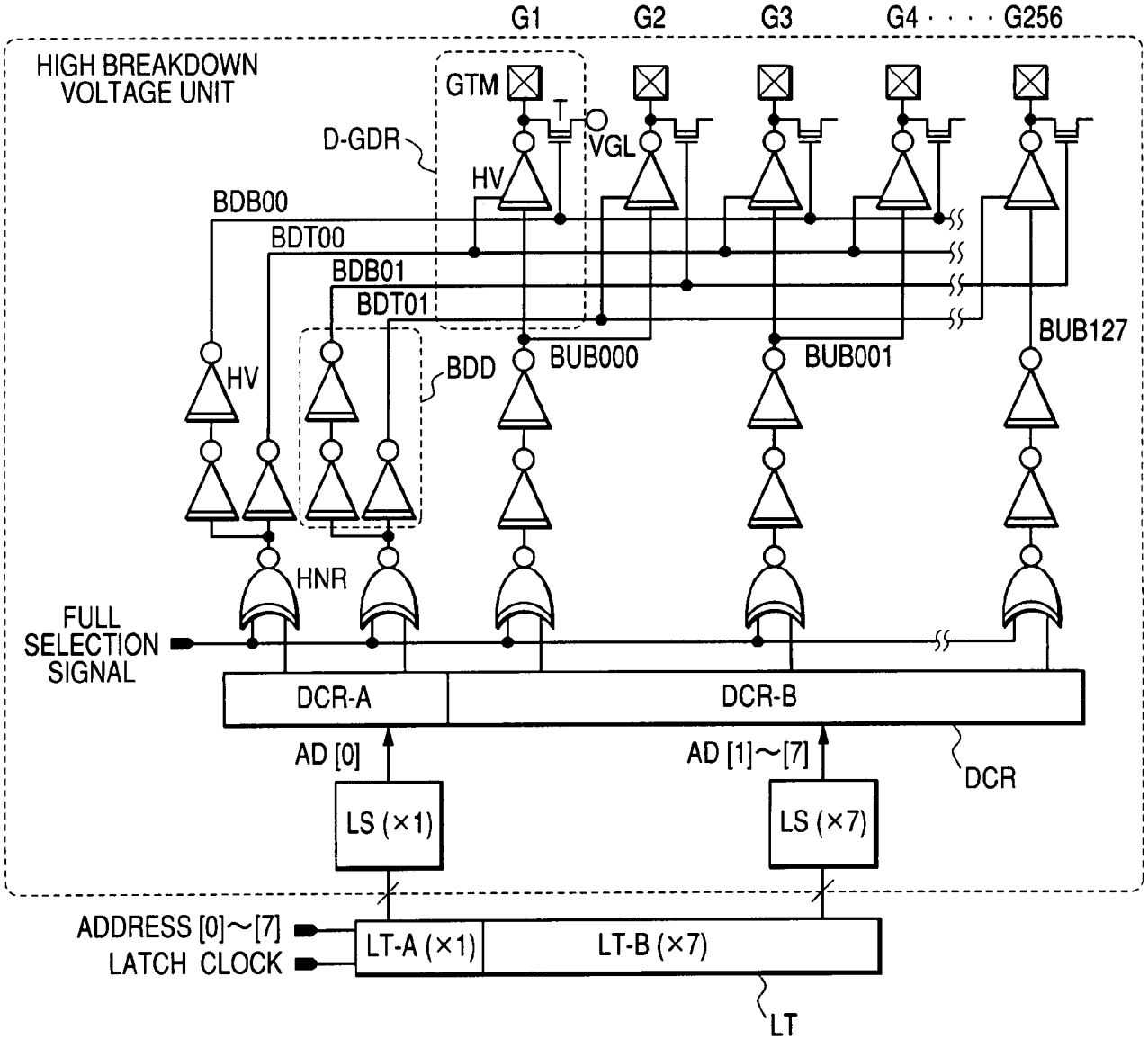
FIG. 12 is a block diagram illustrating an example of the constitution of a gate driver unit for driving a display panel, which is a sixth embodiment of the semiconductor circuit according to the present invention.
Figure 13:
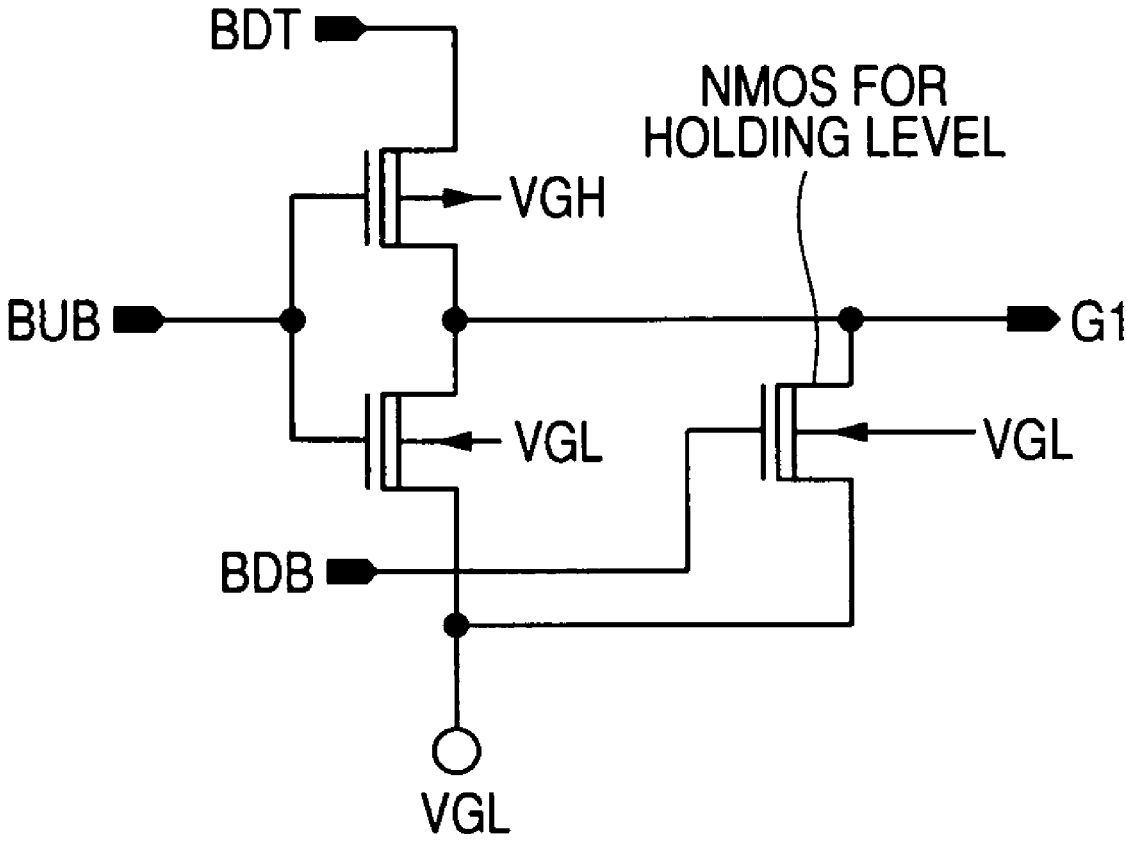
FIG. 13 is a circuit diagram illustrating an example of the constitution of the buffer-decoder driver in FIG. 12.
Figure 14:
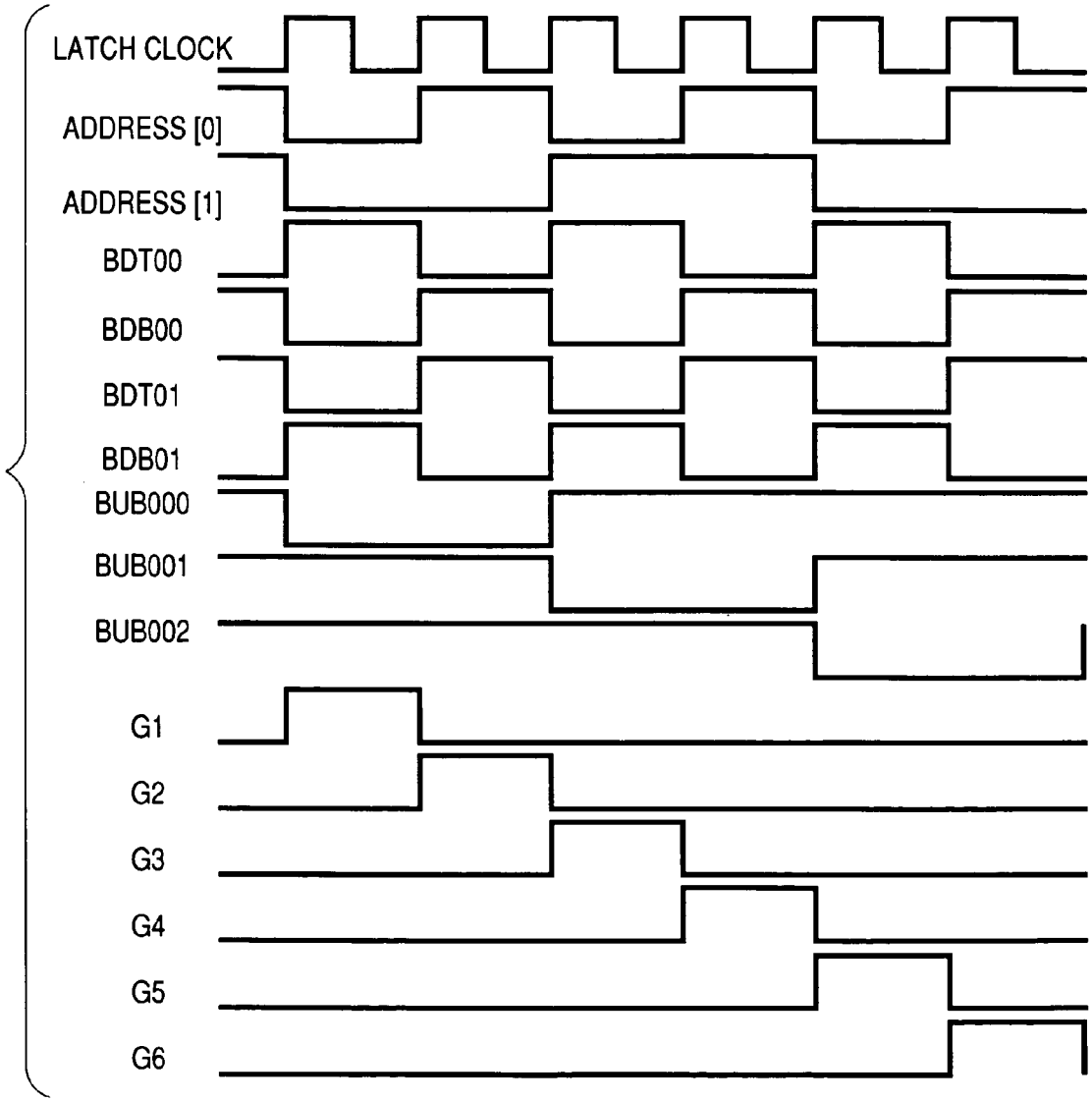
FIG. 14 is a waveform chart illustrating the operation of the gate driver unit in FIG. 12.

FIG. 12 is a block diagram illustrating an example of the constitution of the gate driver unit for driving a display panel, which is the sixth embodiment of the semiconductor circuit according to the present invention. FIG. 13 is a circuit diagram illustrating an example of the constitution of the buffer-decoder driver in FIG. 12, and FIG. 14 is a waveform chart illustrating the operation of the gate driver unit in FIG. 12. In this embodiment, the post-decoders are integrated with buffer circuits constituting gate drivers for driving individual gate lines to form decoder-integrated gate drivers D-GDR. In other words, a post-decode function is added to the buffers of the gate drivers. In FIG. 12, one bit of an inputted 8-bit address signal is latched into the first latch LT-A in the latch circuit LT, and the remaining seven bits are latched into the second latch LT-B in the latch circuit LT. This constitution and the processing by the pre-decode circuit DCR and the preceding elements are the same as in FIG. 9.

The output of the first decoder DCR-A in the pre-decoder DCR is inputted to the buffer-decoder drivers BDD through the respective high breakdown voltage NOR gates HNR. The buffer-decoder driver BDD comprises three high breakdown voltage inverters HV. The waveform inputted to each terminal corresponds to the waveform marked with the same symbol in FIG. 14. The output of the buffer-decoder driver BDD is inputted to the decoder-integrated gate driver D-GDR having post-decoder function. As illustrated in FIG. 13, this decoder-integrated gate driver D-GDR comprises NMOS transistor and PMOS transistor.

The output of the second decoder DCR-B in the pre-decoder DCR is inputted to the decoder-integrated gate driver D-GDR through a high breakdown voltage NOR gate HNR and two high breakdown voltage inverters HV. Each of the decoder-integrated gate drivers D-GDR corresponds to two gate lines.

A pre-decoded signal is inputted to the source terminal of the PMOS of the high breakdown voltage inverter HV constituting the decoder-integrated gate driver D-GDR. When the pre-decoded signal in the source terminal of the PMOS is brought into the low level, the output is also brought into the low level. However, at that time, the output is not completely brought into the low level. To cope with this, a NMOS transistor for holding level is added, as illustrated in FIG. 13. Thus, for example, the high breakdown voltage NAND gates HND in FIG. 9 can be reduced.

An example of operation will be taken. If all the bits AD of an address are at "0," the output BDT00 of the buffer-decoder driver BDD is at the high level, and the output BDB00 is at the low level. The output BUB000 of the second decoder DCR-B is brought into the low level, the output to the gate line 1 is selected. If only bit [0] of the address is at "1," BDB00 is at the low level and BDB00 is at the high level. As BDB00 is at the low level, G1 come to low level to flow current between the source terminal of the PMOS and the drain terminal of the PMOS. And when voltage difference between BUB00 and G1 becomes less or equal threshold voltage of PMOS, the PMOS becomes turn off and the G1 becomes floating level. However, the G1 is held by the NMOS transistor so as to hold level to the low level or the VGL level.

In this embodiment, the buffer circuit of the gate driver is provided with decode function. Then, the gate driver is caused to function as a post-decoder which uses control signals generated from pre-decode signals from the bits of the address signal. Thereby, the number of level conversion circuits is significantly reduced. The NAND circuits HND in the post-decoder circuits are obviated, and the packaging area can be reduced.

Seventh Embodiment

Figure 15:
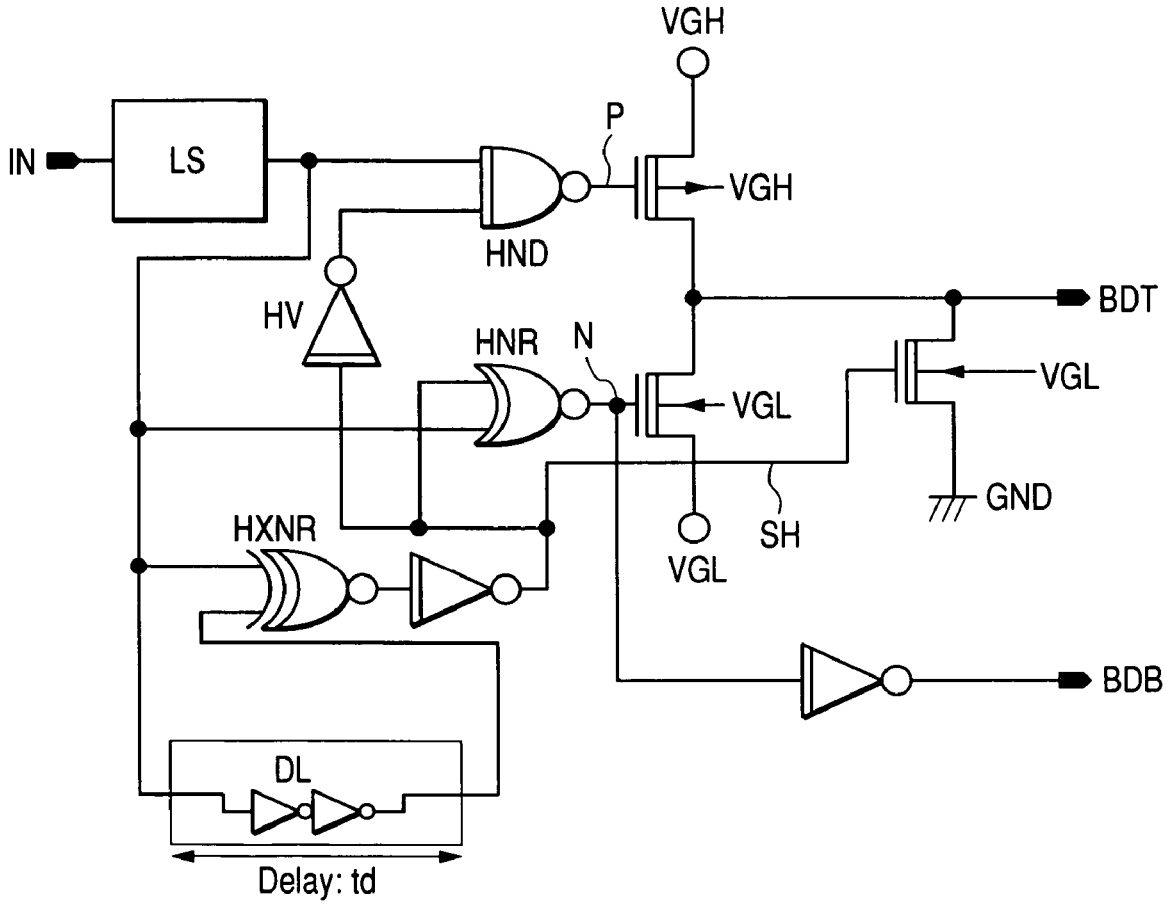
FIG. 15 is a block diagram illustrating an example of the constitution of the major parts of a gate driver unit for driving a display panel, which is a seventh embodiment of the semiconductor circuit according to the present invention.
Figure 16:
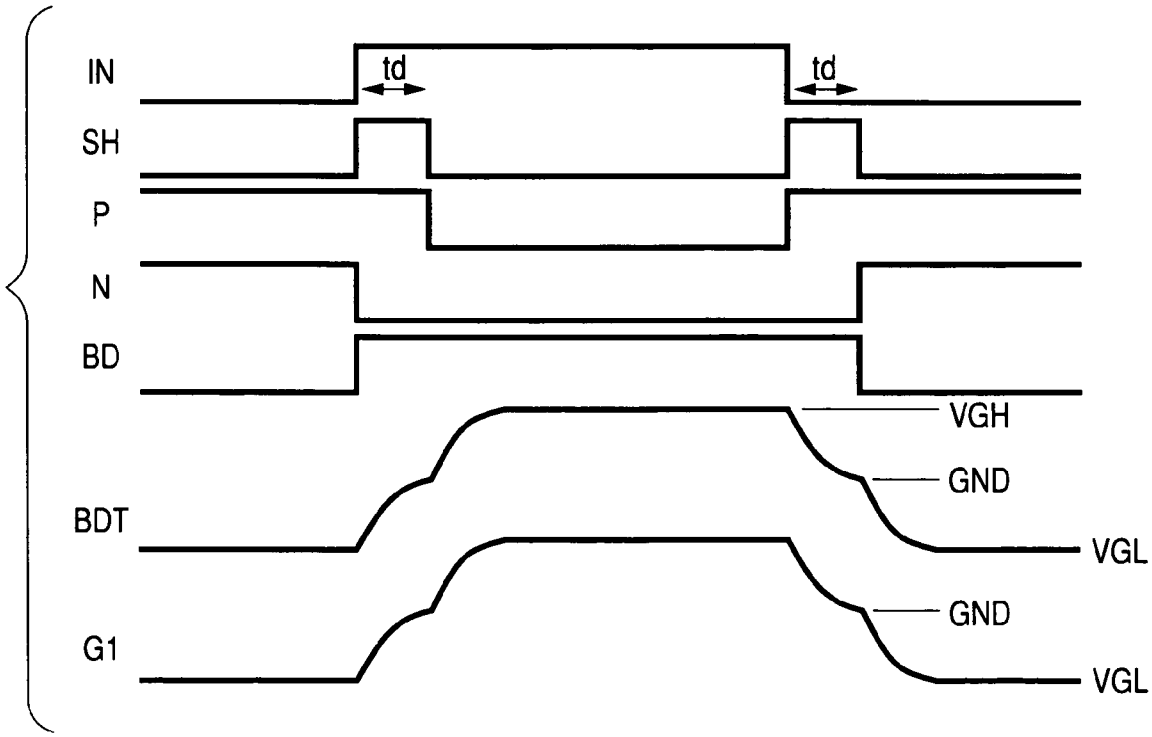
FIG. 16 is an operating waveform chart of the buffer-decoder driver BDD illustrated in FIG. 12.

FIG. 15 is a block diagram illustrating an example of the constitution of the major parts of the gate driver unit for driving a display panel, which is the seventh embodiment of the semiconductor circuit according to the present invention. This is another example of the constitution of the buffer-decoder driver BDD in FIG. 12. With respect to the other aspects than the buffer-decoder driver BDD, the constitution is the same as in FIG. 12. FIG. 16 is an operating waveform chart of the buffer-decoder driver BDD illustrated in FIG. 15.

The circuit in FIG. 15 is obtained by adding to the circuit illustrated in FIG. 13 a circuit comprising: a level conversion circuit LS, a delay circuit DL, a high breakdown voltage exclusive NOR gate HXNR, two high breakdown voltage inverters HV, a high breakdown voltage NAND gate HND, and a high breakdown voltage NOR gate HNR. Thus, the circuit in FIG. 15 is constituted as buffer-decoder driver BDD with short function.

With the constitution in FIG. 12, the buffer-decoder drivers BDD intervene in the output voltage to the gate lines, and thus power is consumed. In this embodiment, the short function indicated in FIG. 16 is added, and the gate voltage is once shorted to ground GND or the like. Thus, gate charging/discharging currents are reduced, and further increase in the packaging area is prevented.

The waveforms in FIG. 16 indicate those of the elements marked with the same symbols in FIG. 15. As illustrated in FIG. 16, the waveform of the buffer-decoder driver BDD in FIG. 12 and the waveform of gate output (only that of G1 is indicated here) have an inflection point at the midpoints in their leading edges and falling edges. (Inflection point is defined as a point at which the positive and negative of the rate of change in increase or decrease are inverted.) These inflection points are positioned in the leading edge and falling edge of the output of point P which is brought into the low level with the timing delayed by the delay circuit DL in FIG. 15.

In this embodiment, the operation of the post-decoder can be checked by the inflection points in the waveform of output to the gate terminals.

Figure 17A:
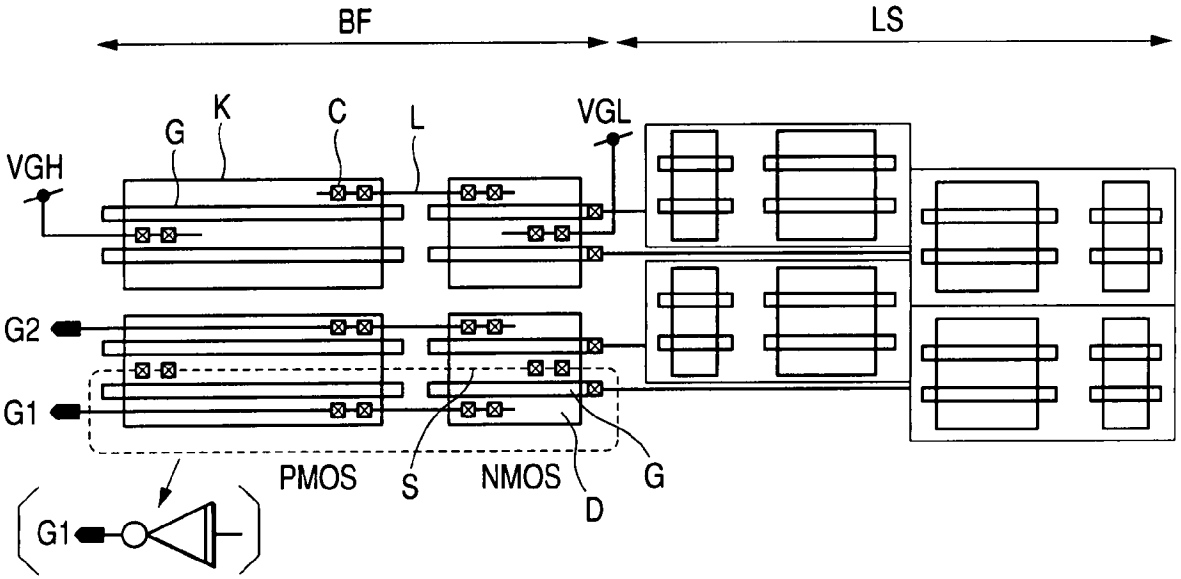
FIGS. 17(*a*) and 17(*b*) are explanatory drawings for comparison.
Figure 17B:
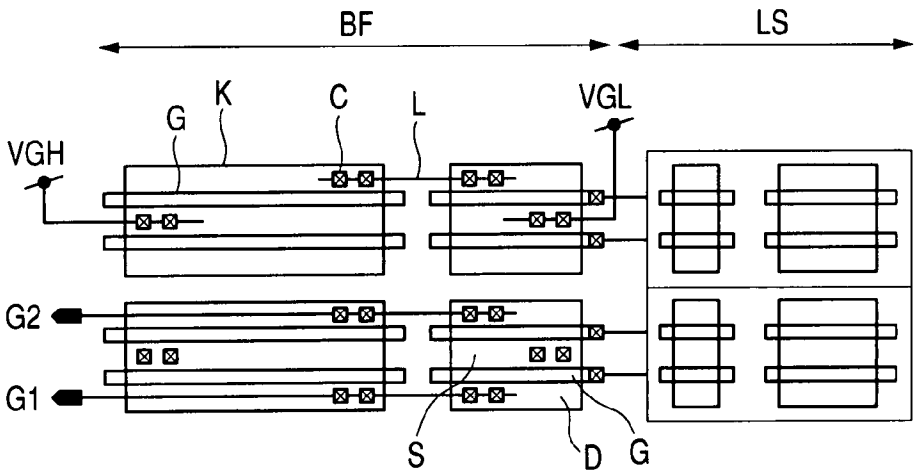

FIGS. 17(*a*) and 17(*b*) are explanatory drawings for comparison of examples of the layout of integrated circuit chip. FIG. 17(*a*) illustrates the layout of an integrated circuit chip mounted with the semiconductor circuit the present inventors previously invented. FIG. 17(*b*) illustrates the layout of an integrated circuit chip mounted with the semiconductor circuit according to the present invention. The integrated circuit chip in FIG. 17(*b*) corresponds to an embodiment of the present invention wherein an address signal is divided into one bit and seven bits and decoded in two stages.

The left halves of FIGS. 17(*a*) and 17(*b*) are the buffer BF portion, and the right halves are the level conversion circuit portion. The buffer BF comprises a PMOS transistor and an NMOS transistor, and comprises their diffusion layer K, gate layer G, contact layer C, wiring layer L, and gate, source, and drain electrodes. In the FIGS. 17 and 18, buffer BF is an inverter HV connected to the gate terminal GTM in respective embodiments of FIGS. 1, 5, 8, 9, 10 and 12.

In the embodiment of the present invention illustrated in FIG. 17(*b*), an address signal of eight bits is divided into one bit and seven bits, and decoded in two stages: pre-decode and post-decode. As is evident from comparison between FIG. 17(*a*) and FIG. 17(*b*), the number of level conversion circuits LS in FIG. 17(*b*) is smaller than that of the integrated circuit chip illustrated in FIG. 17(*a*). Accordingly, the packaging area can be reduced, and a small integrated circuit chip is obtained.

Figure 18A:
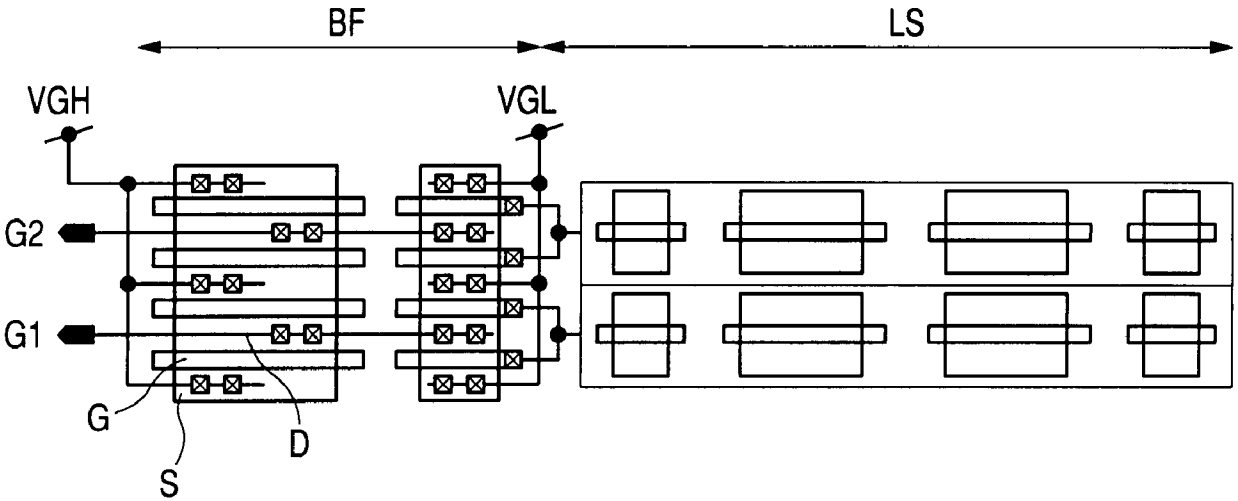
FIGS. 18(*a*) and 18(*b*) are also explanatory drawings for comparison.
Figure 18B:
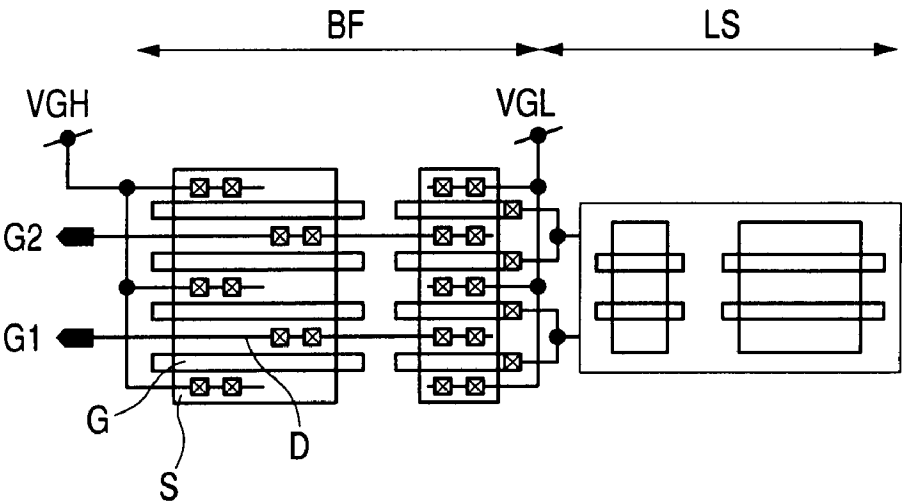

FIGS. 18(*a*) and 18(*b*) are explanatory drawings for comparison of another examples of the layout of integrated circuit chip. FIG. 18(*a*) illustrates the layout of an integrated circuit chip mounted with the semiconductor circuit the present inventors previously invented. FIG. 18(*b*) illustrates the layout of an integrated circuit chip mounted with the semiconductor circuit according to the present invention. The integrated circuit chip in FIG. 18(*b*) also corresponds to an embodiment of the present invention wherein an address signal is divided into one bit and seven bits and decoded in two stages.

In FIGS. 18(*a*) and 18(*b*), the source electrode of the MOS transistor is also used as the source electrode of the adjacent MOS transistor to reduce the packaging area. The number of level conversion circuits is significantly smaller in the embodiment of the present invention illustrated in FIG. 18(*b*). Therefore, the packaging area can be reduced, and a small integrated circuit chip is obtained. Since the number of level conversion circuits LS is smaller than that of the gate line terminals GTM for outputting the gate signals, the degree of freedom in layout is enhanced. Again, the packaging area can be reduced, and a small integrated circuit chip is obtained. Since the number of level conversion circuits LS is smaller than that of the output buffers BF for outputting the gate signals, the degree of freedom in layout is enhanced. Again, the packaging area can be reduced, and a small integrated circuit chip is obtained.

Eighth Embodiment

Figure 19:
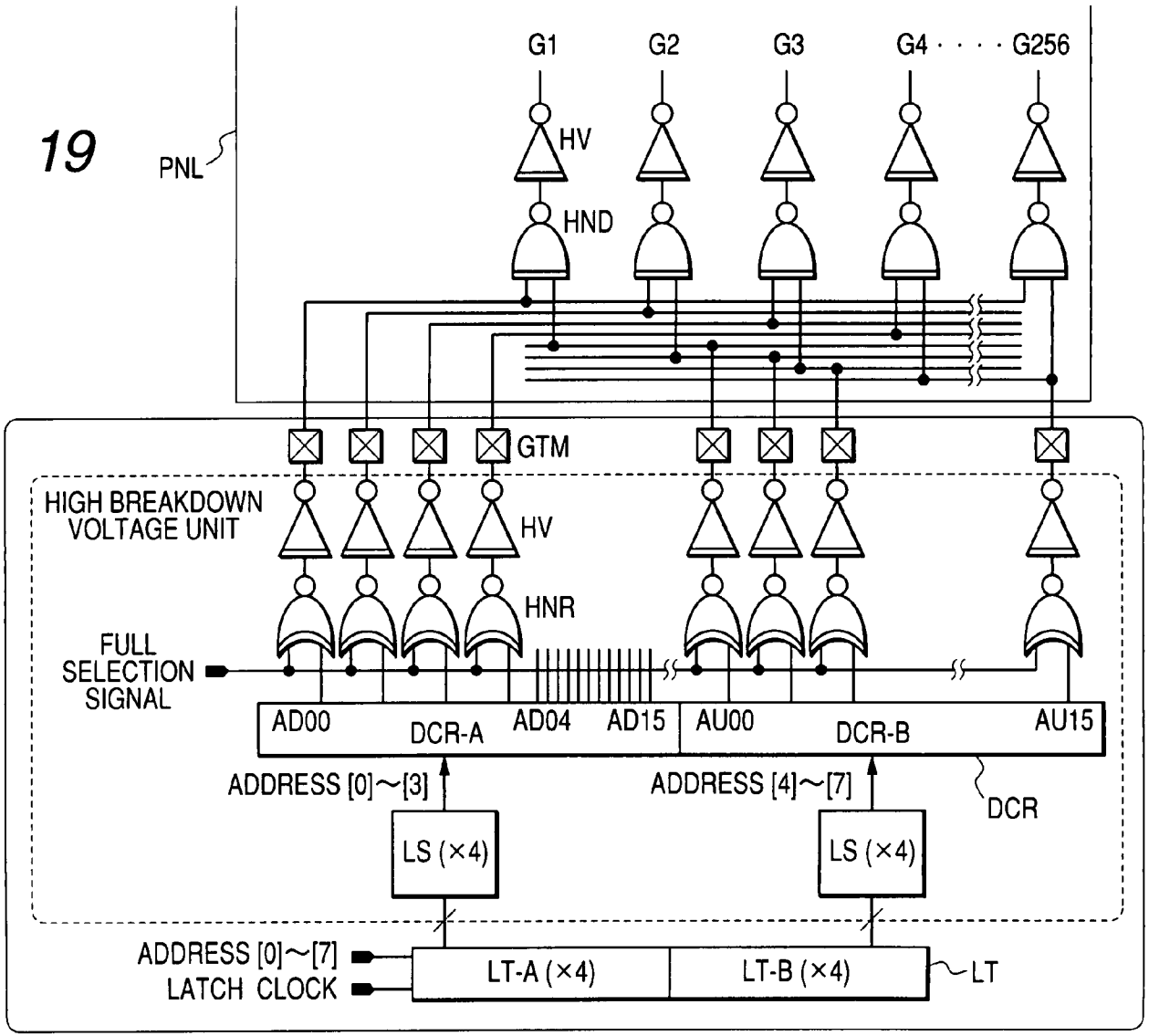
FIG. 19 is a block diagram illustrating an example of the constitution of a gate driver unit for driving a display panel, which is an eighth embodiment of the semiconductor circuit according to the present invention.

FIG. 19 is a block diagram illustrating an example of the constitution of the gate driver unit for driving a display panel, which is the eighth embodiment of the semiconductor circuit according to the present invention. In this embodiment, the gate drivers are incorporated in the display panel PNL. The incorporated gate driver comprises a thin film transistor formed, for example, of low-temperature polysilicon semiconductor. The gate driver unit which generates address signals for the display panel is designated here as gateless driver. In this embodiment, an inputted address signal of eight bits is latched into a latch circuit LT. The latch circuit LT comprises a first latch LT-A and a second latch LT-B each of which latches four bits, and latches address signals by four bits.

Two sets of four bits of an address signal latched into the first latch LT-A and the second latch LT-B are level-converted through level conversion circuits LS, respectively, and inputted to a decoder DCR. The decoder DCR comprises a first decoder DCR-A and a second decoder DCR-B, each of which decodes four level-converted bits of the address signal. The outputs of the first decoder DCR-A and second decoder DCR-B are supplied to the terminals GTM connected with the gate lines of the display panel, through high breakdown voltage NOR gates HNR and high breakdown voltage inverters HV. Thus, in this embodiment, the shift registers SR in the panel GIPNL, required in the embodiments the present inventors previously invented, can be replaced with one NAND gate HND, and the area of the display panel can be reduced. Further, the number of level conversion circuits is significantly reduced, and the area of the semiconductor integrated circuit according to the present invention can be reduced.

Figure 20:
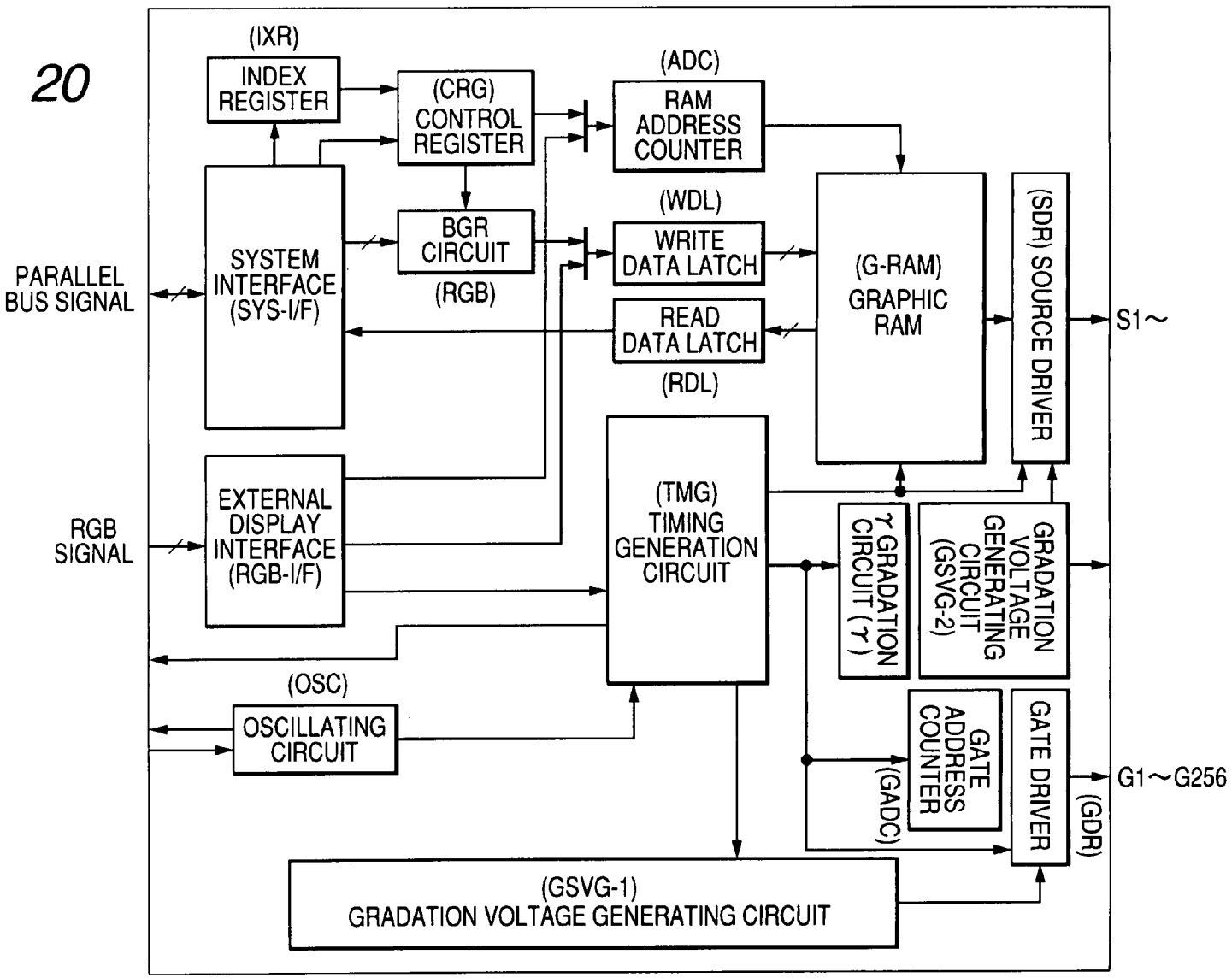
FIG. 20 is a block diagram illustrating an example of a one-chip liquid crystal display panel driver to which the present invention is applied.

FIG. 20 is a block diagram illustrating an example of a one-chip liquid crystal display panel driver to which the present invention is applied. This one-chip liquid crystal display panel driver comprises a system interface SYS-I/F connected with an external signal source through a parallel bus; an external display interface RGB-I/F fed with RGB indicative data; a timing generating circuit TMG; graphic RAM G-RAM; a source driver SDR; a gate driver GDR; and gradation voltage generating circuits GSVG-1 and GSVG-2. In addition, the one-chip liquid crystal display panel driver comprises an index register IXR; a control register CRG; a BGR circuit BGR (RGB-to-BGR conversion); an RAM address counter ADC; a write data latch WDL; a read data latch RDL; a gamma gradation circuit γ; a gate address counter GADC; an oscillating circuit OSC; and the like.

Figure 21A:
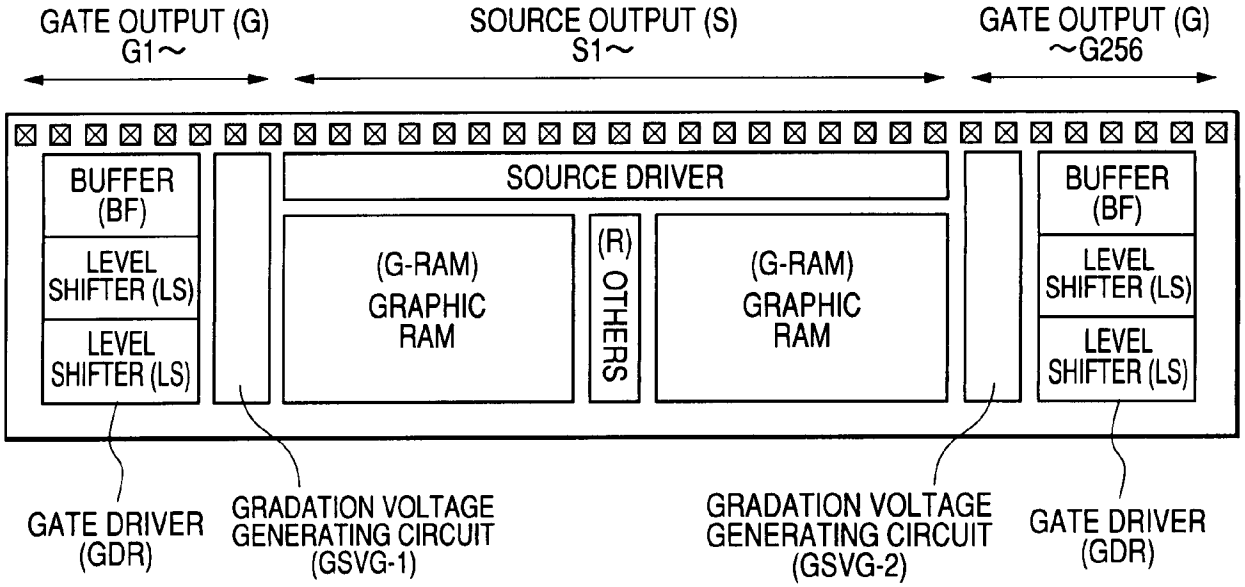
FIGS. 21(*a*) and 21(*b*) are schematic diagrams for comparison.
Figure 21B:
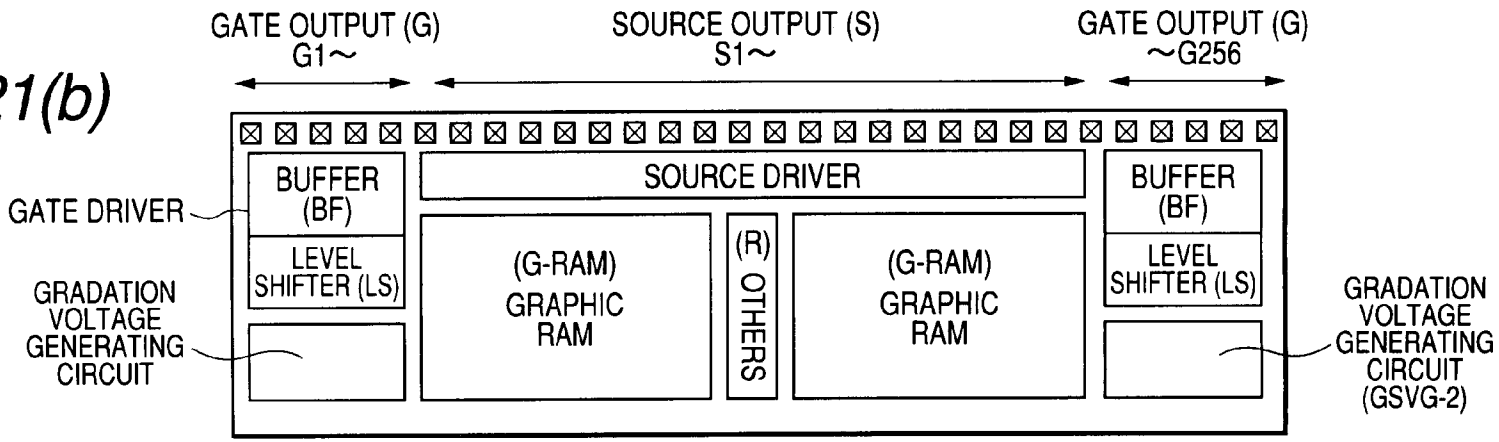

FIGS. 21(*a*) and 21(*b*) are schematic diagrams for comparison of examples of the layer of integrated circuit chip. FIG. 21(*a*) illustrates a one-chip liquid crystal display panel driver the present inventors previously invented. FIG. 21(*b*) illustrates a one-chip liquid crystal display panel driver according to the present invention. In the layout the present inventors previously invented, two divided graphic RAMs G-RAM are mounted in the center, and source terminals S are provided. Two level conversion circuits (level shifters) LS, a buffer BF, and a gradation voltage generating circuit GSVG-1 or GSVG-2 are disposed on both sides of the graphic RAMs G-RAM, and gate output terminals G are respectively provided.

As illustrated in FIG. 21(*b*), the semiconductor integrated circuit chip according to the present invention is smaller in number of level conversion circuits LS than the chip the present inventors previously invented, illustrated in FIG. 21(*a*). Therefore, it turns out from the drawings that the overall size of layout is reduced in the embodiment according to the present invention. Further, since the area of the level conversion circuits LS is small, the degree of freedom in layout is enhanced. In a semiconductor integrated circuit chip having a single gate driver or a chip having no graphic RAM G-RAM, the size is further reduced, and the degree of freedom in layout is further enhanced.

Figure 22:
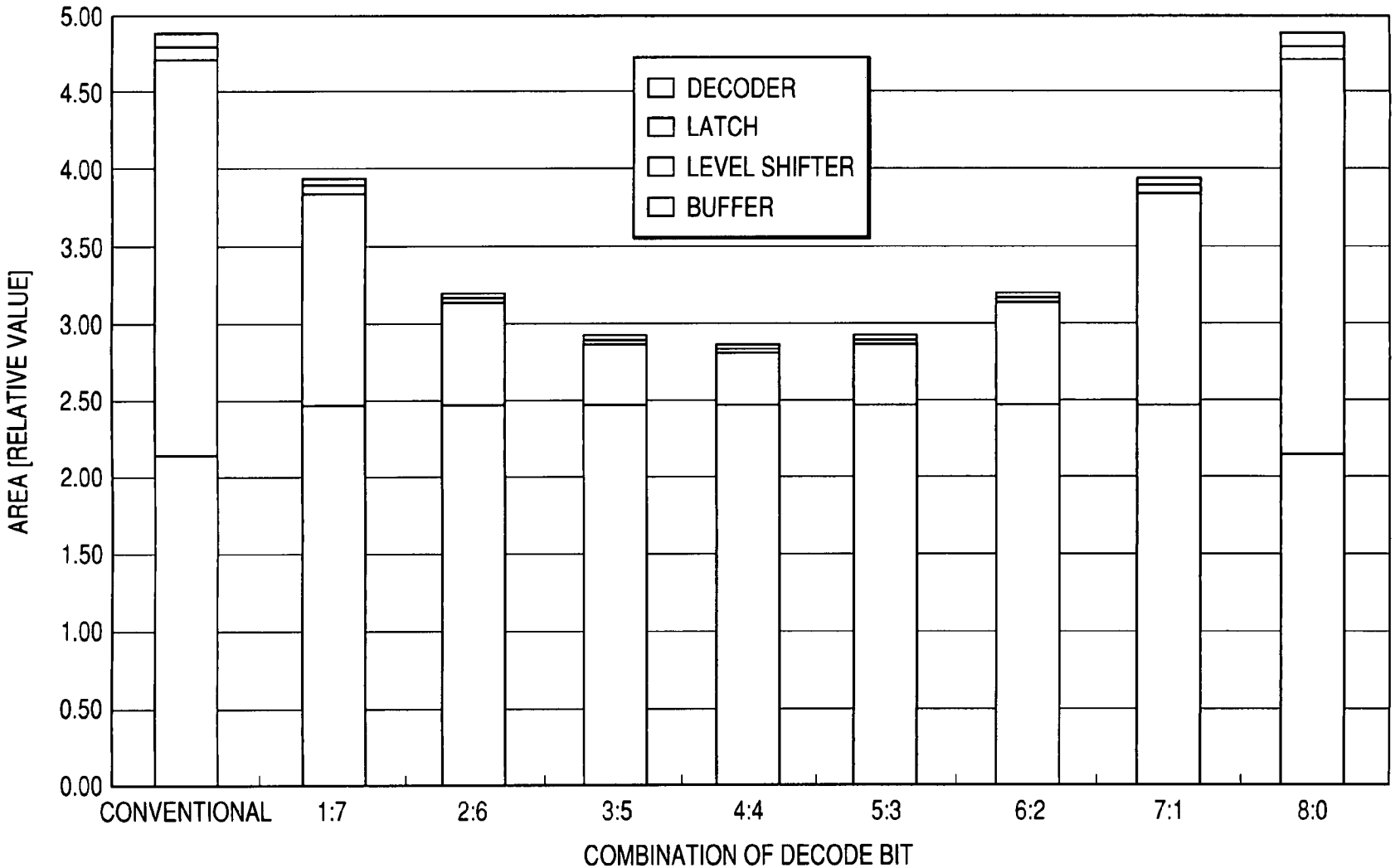
FIG. 22 is an explanatory drawing for comparison between the semiconductor circuit the present inventors previously invented and that according to the present invention. The comparison is with respect to number of decode bits versus packaging area in semiconductor integrated circuit chip. While the previously invented semiconductor circuit decodes all the bits of an address signal in a lump, that according to the present invention adopts two-stage decode method.
Figure 23:
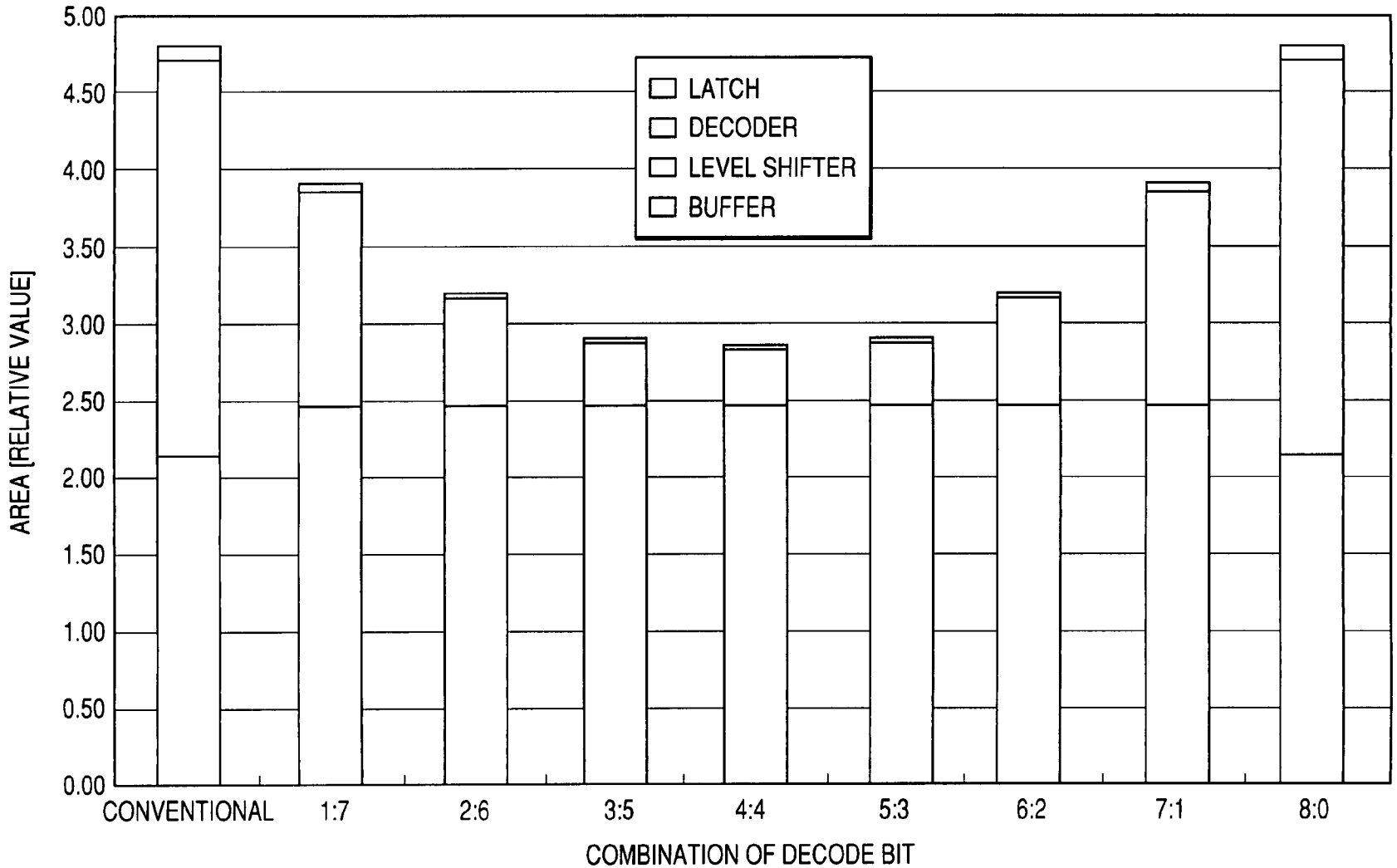
FIG. 23 is an explanatory drawing illustrating another example of comparison between the semiconductor circuit the present inventors previously invented and that according to the present invention. The comparison is with respect to number of decode bits versus packaging area in semiconductor integrated circuit chip. While the previously invented semiconductor circuit decodes all the bits of an address signal in a lump, that according to the present invention adopts two-stage decode method.
Figure 24:
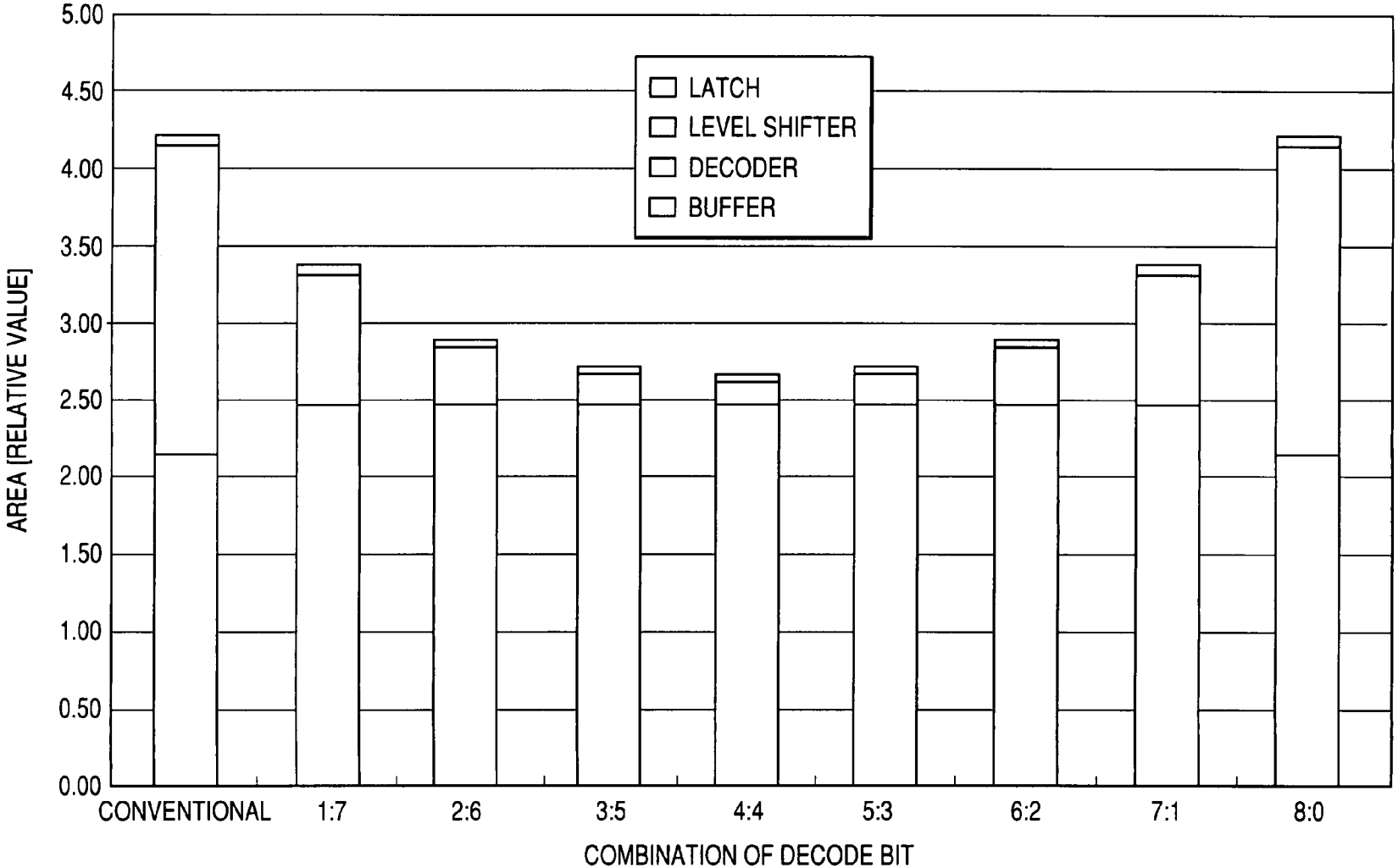
FIG. 24 is an explanatory drawing illustrating a further example of comparison between the semiconductor circuit the present inventors previously invented and that according to the present invention. The comparison is with respect to number of decode bits versus packaging area in semiconductor integrated circuit chip. While the previously invented semiconductor circuit decodes all the bits of an address signal in a lump, that according to the present invention adopts two-stage decode method.

FIG. 22 to FIG. 24 are explanatory drawings for comparison between the semiconductor circuit the present inventors previously invented and that according to the present invention. The comparison is with respect to number of decode bits and packaging area in semiconductor integrated circuit chip. While the previously invented semiconductor circuit decodes all the bits of an address signal in a lump, that according to the present invention adopts two-stage decode method. FIG. 22 illustrates such a constitution that an inputted address signal is pre-decoded and latched, and the resulting output is level-converted and then post-decoded. FIG. 23 illustrates such a constitution that an inputted address signal is latched and pre-decoded, and the resulting output is level-converted and then post-decoded. FIG. 24 illustrates such a constitution that an inputted address signal is latched and level-converted and then pre-decoded, and thereafter post-decoded.

With respect to FIG. 22 to FIG. 24, no consideration is given to the area of the wiring region or the like. In the FIG. 22 to FIG. 24, the horizontal axis indicates how the bits constituting an address signal are divided and combined, and the vertical axis indicates the areas (relative values) of various elements over the semiconductor integrated circuit chip. FIG. 22 shows the areas of the decoder circuits, latch circuits, level conversion circuits (level shifters), and buffers from above. FIG. 23 shows the areas of the latch circuits, decoder circuits, level conversion circuits (level shifters), and buffers from above. FIG. 24 shows the areas of the latch circuits, level conversion circuits (level shifters), decoder circuits, and buffers from above.

In any of FIG. 22 to FIG. 24, the following is apparent: if the bits constituting an 8-bit address signal are divided into four bits and four bits and pre-decoded and post-decoded, the areas are minimized. With respect to how the bits constituting an address signal are divided and pre-decoded and post-decoded, the following is also evident: the smaller the absolute value of the difference between the numbers of divided bits is, the more the packaging area can be reduced. For example, when the combination of the divided bits is five bits and three bits, the packaging area can be reduced more than when the combination is seven bits and one bit. At this time, the packaging area is reduced by reducing the number of level conversion circuits with respect to FIGS. 22 and 23, and by reducing the number of elements constituting the decoder circuits with respect to FIG. 24.

In the aforesaid embodiments, a plurality of bits constituting an address signal are not decoded in a lump, but they are once decoded (pre-decode) and then decoded again (post-decode). With this constitution, the number of level conversion circuits is significantly reduced. Some bits of an address signal are decoded, and the remaining bits of the address signal are separately decoded. With this constitution, the area of the decoder can be reduced. All of gate drivers are not included in a high breakdown voltage unit, but they are divided into a high breakdown voltage unit and a low breakdown voltage unit. Thus, the power consumption and the packaging area can be reduced.

What is claimed is:

1. A semiconductor circuit for supplying gate signals to a display panel in which a large number of pixels comprising active elements are arranged in a matrix pattern, comprising:

a pre-decode circuit that receives first signals based on address signals inputted to the semiconductor circuit and that comprises:

a first decoder that decodes a first portion of the first signals and outputs first decoded signals and a second decoder that decodes a remaining portion of the first signals and outputs second decoded signals;

level converters that convert the first decoded signals and the second decoded signals in a higher voltage level direction and output level-converted signals;

post-decode circuits that receive the level-converted signals based on the first decoded signals and the second decoded signals and generate the gate signals; and gate terminals that are coupled to the post-decode circuits and output the gate signals, wherein the number of level converters is smaller than the number of gate terminals.

2. The semiconductor circuit according to claim 1, comprising:

a latch circuit which is coupled to the pre-decode circuit and which receives the address signals that comprises:

a first latch coupled to the first decoder, that latches the first portion of the address signals and outputs the first signals and a second latch coupled to the second decoder, that latches the remaining portion of the address signals and outputs the second signals, wherein the level converters comprise:

first level conversion circuits coupled between the first decoder and the post-decoder circuits, that shift absolute values of respective voltage levels of the first decoded signals in a higher voltage level direction, second level conversion circuits coupled between the second decoder and the post-decoder circuits, that shift absolute values of respective voltage levels of the second decoded signals in a higher voltage level direction, and wherein the first decoded signals and the second decoded signals, via the first level conversion circuits and the second level conversion circuits, are outputted to the post-decode circuits as the level-converted signals.

3. The semiconductor circuit according to claim 2, wherein the address signals comprise eight bit signals including a one bit signal and a remainder of seven bit signals, and the one bit signal designates the lowest bit signal of the address signals, and wherein said first decoder decodes the lowest bit signal and the second decoder decodes the remaining portion of the address signals.

4. The semiconductor circuit according to claim 2, wherein breakdown voltage of said post decode circuits is higher than that of said latch circuit.

5. The semiconductor circuit according to claim 1, wherein the post-decode circuits comprise buffer-decoders that function as buffer circuits.

6. The semiconductor circuit according to claim 5, wherein said address signals comprise eight signals, including a one bit signal and a remainder of seven signals.

7. A semiconductor circuit for supplying gate signals to a display panel in which a plurality of pixels are arranged in a matrix pattern, comprising:

a latch circuit that receives address signals inputted to the semiconductor circuit, that latches the address signals, and that outputs first signals;

a pre-logic circuit that receives the first signals and that comprises a first logic gate receiving a first portion of the first signals and a second logic gate receiving a remaining portion of the first signals;

post-logic gates that receive output signals from said first and second logic gates;

level conversion circuits that shift absolute values of voltage levels of output signals from said pre-logic gates in a higher voltage level direction; and gate line terminals that are coupled to the post-logic gates and that output the gate signals, wherein breakdown voltage of the post-logic gates is higher than that of said latch circuit, and wherein the number of said level conversion circuits is smaller than that of the gate line terminals.

8. The semiconductor circuit according to claim 7, wherein said latch circuit comprises a first latch that latches a first portion of the address signals and outputs to the first logic gate, and a second latch that latches a remainder of the address signals and outputs to the second logic gate, wherein said level conversion circuits are coupled to the first logic gate and the second logic gate and shift absolute values of respective voltage levels of the first logic gate and the second logic gate in a higher voltage level direction, and wherein the outputs of said first logic gate and said second logic gate, passed through said level conversion circuits, are outputted to post-decode circuits.

9. The semiconductor circuit according to claim 7, wherein said post-logic gates are buffer-logic gates that function as buffer circuits.

10. A semiconductor circuit for supplying gate signals to a display panel in which a plurality of pixels are arranged in a matrix pattern, comprising:

gate terminals for outputting the gate signals;

latch circuits that latch address signals for selecting said gate terminals;

a pre-decode circuit that receives and decodes outputs of the latch circuits;

post-decode circuits that receive and decode outputs of said pre-decode circuit; and level conversion circuits that shift absolute values of the voltage levels of outputs from said pre-decode circuit in a higher voltage level direction and that output to the post-decode circuits, wherein breakdown voltage of said post-decode circuits is higher than that of said latch circuits, and wherein the number of said level conversion circuits is smaller than that of the gate terminals.

11. The semiconductor circuit according to claim 10, wherein bits of said address signals latched into said latch circuits are outputted to said pre-decode circuit, and wherein outputs of said pre-decode circuit, passed through said level conversion circuits, are outputted to said post-decode circuits.

12. The semiconductor circuit according to claim 10, wherein breakdown voltage of said post-decode circuits is higher than that of said latch circuits.

13. The semiconductor circuit according to claim 10, wherein said post-decode circuits are buffer-decoders that function as buffer circuits.

14. The semiconductor circuit according to claim 10 wherein the latch circuits comprise:

a first latch that latches a first portion of the address signals and outputs first signals and a second latch that latches a remaining portion of the address signals and outputs second signals, wherein the pre-decode circuit comprises:

a first decoder coupled to the first latch that decodes a first portion of the first signals and outputs first decoded signals and a second decoder coupled to the second latch that decodes a remaining portion of the first signals and outputs second decoded signals, wherein the level conversion circuits comprise:

first level conversion circuits coupled between the first decoder and the post-decode circuits, that shift absolute values of the respective voltage levels of the first decoded signals in a higher voltage level direction, second level conversion circuits coupled between the second decoder and the post-decode circuits, that shift absolute values of respective voltage levels of the second decoded signals in a higher voltage level direction, wherein the first decoded signals and the second decoded signals, via the first level conversion circuits and the second level conversion circuits, are outputted to the post-decode circuits as level-converted signals, wherein the address signals comprise eight bit signals including a one bit signal and a remainder of seven bit signals, and the one bit signal designates the lowest bit signal of the address signals, and wherein said first decoder decodes the lowest bit signal and the second decoder decodes the remaining portion of the address signals.

* * * * *